US008657434B2

(12) United States Patent
Houjou et al.

(10) Patent No.: US 8,657,434 B2
(45) Date of Patent: Feb. 25, 2014

(54) MATTING AGENT APPLYING DEVICE AND INKJET RECORDING DEVICE

(75) Inventors: Hiroaki Houjou, Kanagawa (JP); Kiyoshi Irita, Kanagawa (JP); Masaru Kobayashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 211 days.

(21) Appl. No.: 13/356,653

(22) Filed: Jan. 24, 2012

(65) Prior Publication Data

US 2012/0212552 A1 Aug. 23, 2012

(30) Foreign Application Priority Data

Feb. 21, 2011 (JP) ..... 2011-034932

(51) Int. Cl.
*B41J 2/01* (2006.01)

(52) U.S. Cl.
USPC ..... 347/101

(58) Field of Classification Search
None
See application file for complete search history.

(56) References Cited

U.S. PATENT DOCUMENTS

2002/0098019 A1* 7/2002 Rasch et al. ..... 399/324

FOREIGN PATENT DOCUMENTS

JP 9-011654 A 1/1997
JP 4010577 B2 6/2003

* cited by examiner

*Primary Examiner* — Stephen Meier
*Assistant Examiner* — Tracey McMillion
(74) *Attorney, Agent, or Firm* — SOLARIS Intellectual Property Group, PLLC

(57) ABSTRACT

A matting liquid coating section supplies a matting liquid to an outer peripheral surface of a pressing roller. At the matting liquid coating section, a web, that is a non-woven fabric or the like and in which is seeped a matting liquid formed from a liquid (silicon oil or the like) in which matting agent particles are dispersed at a predetermined concentration, is trained around a first rod and a second rod, and is made to abut an outer peripheral surface of the pressing roller while running along the outer peripheral surface. The matting liquid is transferred once to the outer peripheral surface of the pressing roller, and the matting agent particles that adhere to the roller surface are again transferred onto a surface of a recording medium.

16 Claims, 15 Drawing Sheets

FIG.12

BASIC SHAPE, ROLLER SURFACE SHAPE, WEB PORE DIAMETER

| | | ROLLER | WEB MEMBER | STACKER BLOCKING PERFORMANCE | UNEVEN GLOSS (AFTER ONE DAY) | DIRTYING BY POWDER PARTICLES WITHIN DEVICE |
|---|---|---|---|---|---|---|
| EXAMPLE | 1 | SURFACE-ROUGHENED ROLLER | WEB MEMBER 1 | A | A | A |
| EXAMPLE | 2 | SURFACE-ROUGHENED ROLLER | WEB MEMBER 2 | A | A | A |
| EXAMPLE | 3 | SURFACE-ROUGHENED ROLLER | WEB MEMBER 3 | A | A | A |
| EXAMPLE | 4 | SURFACE-ROUGHENED ROLLER | WEB MEMBER 4 | B | A | A |
| EXAMPLE | 5 | SURFACE-ROUGHENED ROLLER | WEB MEMBER 5 | B | A | A |
| EXAMPLE | 6 | SURFACE-ROUGHENED ROLLER | WEB MEMBER 6 | B | A | A |
| EXAMPLE | 7 | SURFACE-ROUGHENED ROLLER | WEB MEMBER 7 | C | A | A |
| EXAMPLE | 8 | SURFACE-ROUGHENED ROLLER | WEB MEMBER 8 | C | A | A |
| EXAMPLE | 9 | SURFACE-ROUGHENED ROLLER | WEB MEMBER 9 | C | A | A |
| EXAMPLE | 10 | SMOOTH ROLLER | WEB MEMBER 1 | C | A | A |
| EXAMPLE | 11 | SMOOTH ROLLER | WEB MEMBER 2 | C | A | A |
| EXAMPLE | 12 | SMOOTH ROLLER | WEB MEMBER 3 | C | A | A |

COMPARATIVE EXAMPLES

*WITHOUT APPLYING MATTING AGENT PARTICLES

| | | | | | | |
|---|---|---|---|---|---|---|
| COMPARATIVE EXAMPLE | 1 | SURFACE-ROUGHENED ROLLER | WEB MEMBER 10 | F | A | A |

*FABRIC MATERIAL DIRECTLY CONTACTS PRINTED MATTER (NO ROLLER)

| | | | | | | |
|---|---|---|---|---|---|---|
| COMPARATIVE EXAMPLE | 2 | NONE | WEB MEMBER 3 | A | C | A |

*COAT DISPERSION LIQUID ON ROLLER BY BLADE

| | | | | | | |
|---|---|---|---|---|---|---|
| COMPARATIVE EXAMPLE | 3 | SURFACE-ROUGHENED ROLLER | | A-C | C | A |

*COAT DISPERSION LIQUID ON ROLLER BY COATING ROLLER

| | | | | | | |
|---|---|---|---|---|---|---|
| COMPARATIVE EXAMPLE | 4 | SURFACE-ROUGHENED ROLLER | | A-C | C | A |

*SPRAY POWDER (LARGE AMOUNT) AT SHEET DISCHARGING SECTION

| | | | | | | |
|---|---|---|---|---|---|---|
| COMPARATIVE EXAMPLE | 5 | | | C-D | A | C |

*SPRAY POWDER (SMALL AMOUNT) AT SHEET DISCHARGING SECTION

| | | | | | | |
|---|---|---|---|---|---|---|
| COMPARATIVE EXAMPLE | 6 | | | F | A | B |
| | | | | A-F<br>D AND BETTER ARE EXAMPLES | A-C<br>B AND BETTER ARE EXAMPLES | A-C<br>B AND BETTER ARE EXAMPLES |

FIG.13

ROD ABUTMENT CONDITIONS

| | | FIRST ROD | SECOND ROD | STATE OF ABUTMENT OF FIRST ROD | STACKER BLOCKING PERFORMANCE | UNEVEN GLOSS (IMMEDIATELY AFTER) | UNEVEN GLOSS (ONE DAY AFTER) | ROLLER CLEANING PERFORMANCE |
|---|---|---|---|---|---|---|---|---|
| EXAMPLE | 3 | ABUTTING | SEPARATED | MOVABLE (PRESSED BY SPRING) | A | A | A | A |
| EXAMPLE | 13 | SEPARATED | SEPARATED | | A-B | A | A | A |
| EXAMPLE | 14 | ABUTTING | ABUTTING | MOVABLE (PRESSED BY SPRING) | A-B | A | A | A |
| EXAMPLE | 15 | SEPARATED | ABUTTING | | A-C | A | A | A |
| EXAMPLE | 16 | ABUTTING | NONE | MOVABLE (PRESSED BY SPRING) | C | A | A | B |
| EXAMPLE | 17 | ABUTTING | SEPARATED | IMMOBILE (FIXED BY SCREW) | A-B | A-B | A | A |
| EXAMPLE | 18 | ABUTTING | ABUTTING | IMMOBILE (FIXED BY SCREW) | B-C | A-B | A | A |
| EXAMPLE | 19 | ABUTTING | NONE | IMMOBILE (FIXED BY SCREW) | C | B | A | B |
| | | | | | A-F D AND BETTER ARE EXAMPLES | A-C B AND BETTER ARE EXAMPLES | A-C B AND BETTER ARE EXAMPLES | A-C B AND BETTER ARE EXAMPLES |

FIG.14

ROLLER SURFACE ROUGHENING CONDITIONS

| | | ROLLER SURFACE Rq[μm] | SURFACE ROUGHENING TREATMENT METHOD | GROOVE FORMATION ANGLE [°] | STACKER BLOCKING PERFORMANCE | ROLLER OFFSET PERFORMANCE |
|---|---|---|---|---|---|---|
| EXAMPLE | 20 | 1.8 | SANDBLASTING | | B | A |
| EXAMPLE | 21 | 2.3 | SANDBLASTING | | A | A |
| EXAMPLE | 3 | 5.8 | SANDBLASTING | | A | A |
| EXAMPLE | 22 | 7 | SANDBLASTING | | A | A |
| EXAMPLE | 31 | 12.1 | SANDBLASTING | | A | B |
| EXAMPLE | 32 | 1.5 | SANDPAPER | 30 | B | A |
| EXAMPLE | 33 | 2.4 | SANDPAPER | 30 | A | A |
| EXAMPLE | 34 | 5.9 | SANDPAPER | 30 | A | A |
| EXAMPLE | 35 | 8.1 | SANDPAPER | 30 | A | A |
| EXAMPLE | 36 | 10.7 | SANDPAPER | 30 | A | B |
| EXAMPLE | 35 | 5.6 | SANDPAPER | 0 | A | A |
| EXAMPLE | 37 | 6.2 | SANDPAPER | 57 | A | A |
| EXAMPLE | 38 | 5.5 | SANDPAPER | 72 | B | A |
| EXAMPLE | 39 | 6 | SANDPAPER | 90 | B | A |
| | | | | | A-F D AND BETTER ARE EXAMPLES | A-C B AND BETTER ARE EXAMPLES |

FIG.15

ROLLER PROPERTIES

| | | ROLLER SURFACE E [mN/m] | ROLLER SURFACE LAYER THICKNESS[μm] | ROLLER MATERIAL | ROLLER RUBBER HARDNESS[° ] | ROLLER RUBBER THICKNESS[mm] | STACKER BLOCKING PERFORMANCE | ROLLER DURABILITY |
|---|---|---|---|---|---|---|---|---|
| EXAMPLE | 3 | 15 | 100 | Si RUBBER | 70 | 4 | A | A |
| EXAMPLE | 40 | 26 | 100 | Si RUBBER | 70 | 4 | A | A |
| EXAMPLE | 41 | 41 | 100 | Si RUBBER | 70 | 4 | B | A |
| EXAMPLE | 42 | 52 | 100 | Si RUBBER | 70 | 4 | B-C | A |
| EXAMPLE | 43 | 15 | 25 | Si RUBBER | 70 | 4 | A | B |
| EXAMPLE | 44 | 15 | 50 | Si RUBBER | 70 | 4 | A | A |
| EXAMPLE | 45 | 15 | 200 | Si RUBBER | 70 | 4 | A | A |
| EXAMPLE | 46 | 15 | 250 | Si RUBBER | 70 | 4 | A | B |
| EXAMPLE | 47 | 15 | 100 | Si RUBBER | 30 | 6 | A | A |
| EXAMPLE | 48 | 15 | 100 | Si RUBBER | 80 | 4 | B | A |
| EXAMPLE | 49 | 15 | 100 | Si RUBBER | 70 | 0.5 | B | A |
| EXAMPLE | 50 | 15 | 100 | Si RUBBER | 70 | 1 | A | A |
| EXAMPLE | 51 | 15 | 100 | Si RUBBER | 70 | 2 | A | A |
| EXAMPLE | 52 | 15 | 100 | Si RUBBER | 70 | 6 | A | A |
| EXAMPLE | 53 | 15 | 100 | FLUORINE RUBBER | 70 | 4 | A | A |
| EXAMPLE | 54 | 15 | 100 | ALUMINUM | | 4 | C | A |
| | | | | | | | A-F D AND BETTER ARE EXAMPLES | A-C B AND BETTER ARE EXAMPLES |

FEEDING DIRECTION

| | | FABRIC MATERIAL FEEDING DIRECTION | | STACKER BLOCKING PERFORMANCE | ROLLER CLEANING PERFORMANCE |
|---|---|---|---|---|---|
| EXAMPLE | 5 | DIRECTION OPPOSITE ROLLER ROTATING DIRECTION | | A | A |
| EXAMPLE | 55 | SAME DIRECTION AS ROLLER ROTATING DIRECTION | | B | B |

MATTING AGENT APPLYING DEVICE AND INKJET RECORDING DEVICE

CROSS-REFERENCE TO RELATED APPLICATION

This application claims priority under 35 USC 119 from Japanese Patent Application No. 2011-034932 filed on Feb. 21, 2011, the disclosure of which is incorporated by reference herein.

BACKGROUND OF THE INVENTION

1. Field of the Invention

The present invention relates to a matting agent applying device and an inkjet recording device.

2. Description of the Related Art

Conventionally, inkjet printers have had the problem that printed matter, for which processing is completed, are damaged due to a phenomenon known as blocking in which inks on stacked printed matter adhere (bond) to one another due to insufficient drying and insufficient fixing of the image portions. In high-mass-production inkjet printers in particular, because there is the tendency for the drying and fixing time to be short, it is easy for insufficient drying and insufficient fixing to occur, and further, it is easy for blocking to arise when carrying out printing on thick paper.

Such blocking may arise, in addition to inkjet printers, in offset printers as well for example. In offset printers, blocking is prevented by spraying, onto the sheet surfaces, a powder for preventing adhesion between sheets.

However, with a powder spraying method, the problem arises that the printer interior is dirtied due to diffusion of excess powder, and, when carrying out double-sided printing, due to powder that has been supplied to printed matter dropping-off at the time of printing the reverse surface. In particular, in an inkjet printer of a type that carries out printing by coating a pre-processing liquid onto the sheets, the powder spraying method may become problematic with respect to the points that the powder may become mixed into the pre-processing liquid coating section, or poor ejection may be caused due to the powder adhering to the inkjet heads.

Thus, an image recording device has been disclosed that, in order to prevent blocking due to the ink of printed matter immediately after printing and before drying, transfers a powder, that is attracted to and held at the outer peripheral surface of a rotating roller, onto the ink on the printed image surface of the printed matter, by the viscosity of the ink (see, for example, Japanese Patent Application Laid-Open (JP-A) No. 09-011654).

Or, there is a method (see, for example, Japanese Patent No. 4010577) in which a matting agent is affixed at predetermined intervals onto a sheet by an affixing roller having concave portions at the surface thereof, and diffusion of the matting agent within the printer is prevented, and the matting agent is prevented from dropping-off due to the matting agent being dispersed within a solvent that is adhesive. Further, there is a method in which a matting agent is prevented from dropping-off due to the matting agent being dispersed in a solvent that is not adhesive, and, after coating onto the printed matter, heating is carried out, and the solvent is thereby evaporated and the matting agent is fused and fixed.

In the structure disclosed in aforementioned JP-A No. 09-011654, the powder is supplied only to the printed image surface of the printed matter. Therefore, the powder does not overflow off of the printed matter after printing, and only the minimum needed amount of powder is used, and there is the effect of cutting-down on the amount of powder. However, because a powder is used, dirtying of the device interior cannot be avoided. Moreover, because the rotating roller wipes-off particles that have been transferred once onto the printed matter, there is the problem that the efficiency of transferring the powder is low and a sufficient performance cannot be obtained.

Further, the structure of Japanese Patent No. 4010577 discloses a method in which a matting agent is prevented from dropping-off by dispersing the matting agent in an aqueous solvent that has an adhesive function. However, although dirtying of the device is improved, it is easy for ink to gradually remain in the concave portions of the coating roller, and there is the problem that it is difficult to maintain good coatability (the ability to transfer the amount of the matting agent that must be applied). Further, when spraying powder particles, the amount of particles that is consumed itself becomes large.

SUMMARY OF THE INVENTION

Thus, the above-described problems can be addressed by using a structure in which matting agent particles are applied by causing a fabric material, in which a matting agent particle dispersion liquid is impregnated, to planarly contact a matting agent application roller, and applying, by pressing, the matting agent to printed matter by the application roller.

In view of the above-described circumstances, an object of the present invention is to provide a matting agent applying device and an inkjet recording device that reduce dirtying of a device interior by a matting agent, and suppress the amount of matting agent that is consumed.

A matting agent applying device of a first aspect of the present invention includes: an application strip material that is impregnated with a dispersion liquid in which matting agent particles are dispersed; and an application roller to whose surface the dispersion liquid is supplied due to the application roller contacting the application strip material, and that applies, by pressing, the matting agent particles that are within the dispersion liquid to a surface of a recording medium, wherein, on a conveying path along which the application strip material is conveyed from a state of being wound on a supply roller toward a take-up roller and is taken-up on the take-up roller, the application strip material is trained along a surface of the application roller, and due thereto, the dispersion liquid is supplied to the surface of the application roller In accordance with the above-described structure, a dispersion liquid, in which is dispersed a matting agent that improves the stacker blocking performance, is impregnated in the application strip material. When the dispersion liquid is applied by pressing to the surface of a recording medium by the application roller, the application strip material, that is wound on the supply roller, is trained along the surface of the application roller while on the conveying path along which the application strip material is taken-up onto the take-up roller, and supplies the dispersion liquid. Due thereto, scattering of the matting agent within the device is prevented, and, as compared with supplying the dispersion liquid by a coating roller or a blade, the amount of the matting agent that is consumed can be reduced.

In the matting agent applying device of the above-described structure, the application strip material may be trained around a first rod that is at a conveying direction upstream side and a second rod that is at a conveying direction downstream side, and contact the application roller over a length in a peripheral direction of the application roller.

In accordance with the above-described structure, due to the application strip material planarly contacting (surface-contacting) the application roller along the peripheral direction of the application roller, it is easy for the matting agent particles to be scraped-off from the application strip material, the transfer performance of the matting agent particles onto the application roller surface is improved, the application roller surface is cleaned by the surface of the application strip material at which consumption of the particles has been completed, and the transfer performance can be maintained.

In the matting agent applying device of the above-described structure, a rotating direction of the application roller and a feeding direction of the application strip material may be opposite one another.

In accordance with the above-described structure, it is easy for the matting agent particles to be scraped-off from the application strip material, the transfer performance of the matting agent particles onto the application roller surface is improved, the application roller surface is cleaned by the surface of the application strip material at which consumption of the particles has been completed, and the transfer performance can be maintained.

In the matting agent applying device of the above-described structure, the application strip material may be made to abut an outer peripheral surface of the application roller at the first rod.

In accordance with the above-described structure, a bead (pool of liquid) of the matting agent dispersion liquid is formed at the nip portion between the application roller and the application strip material whose back surface is pressed by the first rod. Due thereto, the matting agent is supplied stably from the application strip material to the application roller surface.

In the matting agent applying device of the above-described structure, the first rod may be urged by a spring toward the outer peripheral surface of the application roller, and cause the application strip material to abut the outer peripheral surface of the application roller.

In accordance with the above-described structure, the bead (pool of liquid) of the matting agent dispersion liquid, that is formed at the nip portion between the application roller and the application strip material whose back surface is pressed by the first rod, is prevented from becoming unstable due to fluctuations of the impression cylinder (the recording medium supporting body), and the transfer performance is maintained. Further, the first rod is prevented from abutting the surface of the application roller at an excessive pressure, and the lifespan of the application roller can be maintained.

In the matting agent applying device of the above-described structure, the second rod may be set apart from an outer peripheral surface of the application roller.

In accordance with the above-described structure, by setting the application roller and the application strip material, whose back surface is pressed by the second rod, apart from one another, the matting agent, that remains on the transfer roller surface without having been transferred onto the recording medium, is taken-into the bead (the pool of liquid) without being removed at the second rod, and can be re-used. Further, wear of the application roller surface is reduced, and the lifespan thereof can be maintained.

In the matting agent applying device of the above-described structure, an outer peripheral surface of the application roller may be subjected to a surface roughening treatment.

In accordance with the above-described structure, the matting agent particles, that have been applied once to the recording medium surface, can be prevented from being removed by the application roller.

In the matting agent applying device of the above-described structure, the surface roughening treatment of the application roller may be a sandblasting treatment.

In accordance with the above-described structure, by a sandblasting treatment, random indentations and protrusions can be formed isotropically while the particle size and pressure are controlled, and the particles can be applied uniformly onto the recording medium.

In the matting agent applying device of the above-described structure, the sandblasting treatment may be carried out by abrading the outer peripheral surface of the application roller by sandpaper at an angle $\alpha$ that is $0° \leq \alpha 90°$ with respect to a peripheral direction.

In accordance with the above-described structure, by a sandpaper treatment, a pattern of indentations and protrusions can be formed anisotropically while the roughness is controlled, and the particles can be applied uniformly onto the recording medium.

In the matting agent applying device of the above-described structure, the angle $\alpha$ may be $0° < \alpha < 60°$.

In accordance with the above-described structure, in applying particles onto the roller surface from a fabric material, the scraping-off effect becomes a maximum at $\alpha = 0°$. On the other hand, in applying particles from the roller surface onto the recording medium surface, the releasing effect becomes a maximum at $\alpha = 90°$. Therefore, if the angle $\alpha$ is made to be $0° < \alpha < 60°$, much importance is given to the angle at which the scraping-off effect becomes a maximum, whereas a releasing effect of a certain extent can also be expected.

In the matting agent applying device of the above-described structure, a root mean square roughness Rq of the outer peripheral surface of the application roller may be 2 μm to 10 μm.

In accordance with the above-described structure, by making the root mean square roughness Rq of the outer peripheral surface of the application roller be greater than or equal to 2 μm, the wiping-off ability of the application roller itself deteriorates. The transfer of the matte agent from the application strip material to the application roller, and the transfer of the matting agent from the application roller to the recording medium, can be carried out efficiently. Form the standpoint of preventing image offset onto the roller, it is preferable to limit Rq to less than or equal to 10 μm.

In the matting agent applying device of the above-described structure, the application roller may be an elastic roller.

In accordance with the above-described structure, because the application roller properly deforms due to the elasticity of the surface thereof, the number of matting agent particles that are transferred onto the surface of the recording medium can be made to be large.

In the matting agent applying device of the above-described structure, an outer peripheral surface of the application roller may have surface energy of 10 mN/m to 40 mN/m.

In accordance with the above-described structure, excessive supply of the matting agent dispersion liquid from the application strip material to the application roller surface is prevented and if the surface EN (surface energy) is less than or equal to 40 mN/m, the matting agent particles can be easily transferred from the application roller to the recording medium surface due to the releasability of the application roller surface. From the standpoint of preventing deterioration in the uniformity of transfer due to liquid repulsion on the roller, it is preferable that the surface EN be greater than or equal to 10 mN/m.

In the matting agent applying device of the above-described structure, the application roller may have a rubber layer having a rubber hardness of 30° to 70° and a thickness of 1 mm to 8 mm, and a surface film layer that is formed by a fluorine film and that covers the rubber layer from an exterior and has a thickness of 50 μm to 200 μm.

From the standpoint of durability of the surface film layer with respect to the surface roughening treatment, a thick surface film is good. However, in accordance with the above-described structure, the surface film layer is prevented from becoming too thick, and the stress difference due to the difference between the inner diameter and the outer diameter when the surface layer film is wound on the rubber layer is prevented from becoming large. Further, in order to make the number of transferred particles large, it is good for the rubber layer to deform to the proper degree with respect to the size of the particles, and the rubber layer can be made to be a layer that deforms easily and whose durability can be maintained, with a thickness of 1 mm to 8 mm and a rubber hardness that is difficult to deteriorate (greater than or equal to 30°) and that is soft (less than or equal to 70°).

In the matting agent applying device of the above-described structure, the application strip material may be formed of fibers, and a void pore diameter of a mesh of the application strip material may be 25 μm to 150 μm.

In accordance with the above-described structure, because the void (gap) pore diameter between the fibers is greater than or equal to 25 μm, the matting agent particle transferring performance from the application strip material to the application roller is improved. Further, it is possible to avoid a situation in which the liquid cannot be held at greater than or equal to 150 μm.

An inkjet recording device of a second aspect of the present invention has the matting agent applying device of any of the above-described structures.

In accordance with the above-described structure, a dispersion liquid, in which is dispersed a matting agent that improves the stacker blocking performance, is impregnated in the application strip material. When the dispersion liquid is applied by pressing to the surface of a recording medium by the application roller, the application strip material, that is wound on the supply roller, is trained along the surface of the application roller while on the conveying path along which the application strip material is taken-up onto the take-up roller, and supplies the dispersion liquid. Due thereto, scattering of the matting agent within the device is prevented, and, as compared with supplying the dispersion liquid by a coating roller or a blade, the amount of the matting agent that is consumed can be reduced.

Because the present invention is structured as described above, there are provided a matting agent applying device and an inkjet recording device that reduce dirtying of a device interior by a matting agent, and suppress the amount of matting agent that is consumed.

BRIEF DESCRIPTION OF THE DRAWINGS

FIG. 12 is a table showing differences in performances due to differences in rollers and webs of the matting agent supplying section relating to the exemplary embodiment of the present invention;

FIG. 13 is a table showing differences in performances due to differences between rod abutment conditions of the matting agent supplying section relating to the exemplary embodiment of the present invention;

FIG. 14 is a table showing differences in performances due to differences in roller surface roughening conditions of the matting agent supplying section relating to the exemplary embodiment of the present invention; and FIG. 15 is a table showing differences in performances due to differences in roller characteristics and web feeding direction of the matting agent supplying section relating to the exemplary embodiment of the present invention.

DETAILED DESCRIPTION OF THE INVENTION

Examples of exemplary embodiments relating to the present invention are described hereinafter with reference to the drawings.

Figure 1:
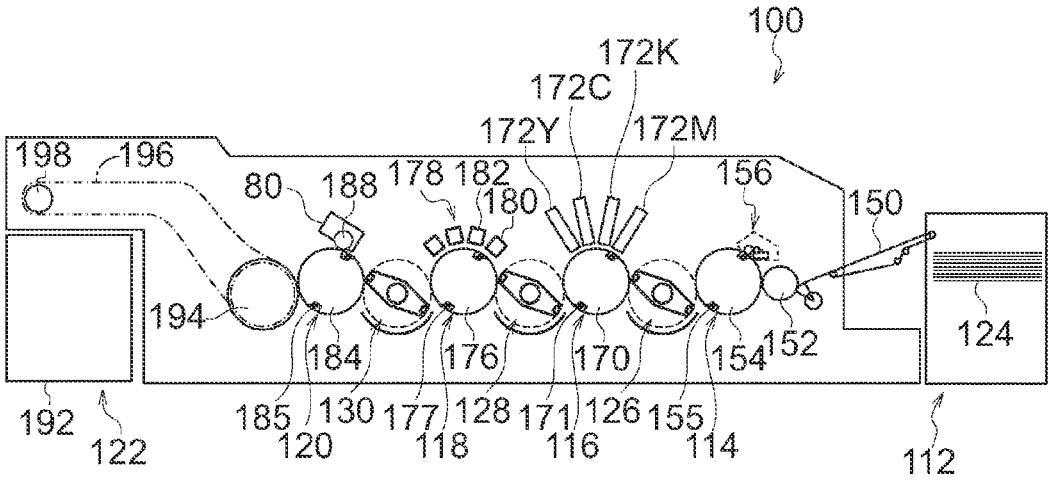
FIG. 1 is a schematic drawing showing an image recording device relating to an exemplary embodiment of the present invention.

FIG. 1 is a schematic structural drawing showing the overall structure of an inkjet recording device relating to an exemplary embodiment of the present invention.

An inkjet recording device 100 is an impression-cylinder direct-drawing inkjet recording device that forms a desired color image by ejecting aqueous inks, that contain thermoplastic resin and color materials, of plural colors from inkjet heads 172M, 172K, 172C, 172Y, onto the recording surface of a recording medium P that is held at an impression cylinder (an image drawing drum 170) of an image drawing section 116. The inkjet recording device 100 is an on-demand type image forming device to which is applied a two-liquid reaction (agglomeration) method that carries out image formation on the recording medium P by, before ejecting ink, applying a processing liquid (containing an agglomerating agent that causes components within the ink compositions to agglomerate) onto the recording medium P and causing the processing liquid and the liquid inks to react.

Namely, as shown in FIG. 1, the inkjet recording device 100 is mainly structured by a sheet feeding section 112, a processing liquid applying section 114, the image drawing section 116, a drying section 118, a fixing section 120, and a sheet discharging section 122.

The sheet feeding section 112 is a mechanism that feeds the recording medium P to the processing liquid applying section 114. The recording media P, that are cut sheets, are stacked in the sheet feeding section 112. A sheet feed tray 150 is provided at the sheet feeding section 112, and the recording media P are fed one-by-one from the sheet feed tray 150 to the processing liquid applying section 114. In order to prevent floating-up of the recording medium P, suction holes may be provided in the outer surface of the sheet feed tray 150, and a suction means that carries out suction from the suction holes may be connected thereto.

In the inkjet recording device 100 of the present exemplary embodiment, plural types of the recording media P that are different paper types or sizes (sheet sizes) can be used as the recording media P. An aspect is also possible in which plural sheet trays (not shown), in which various types of recording media are separately stacked respectively, is provided at the sheet feed section 112, and the sheet that is fed from these plural sheet trays to the sheet feed tray 150 is switched automatically. Further, an aspect is also possible in which an operator selects or replaces a sheet feed tray as needed. Note that, in the present example, cut sheets are used as the recording media P, but a structure is possible in which the recording medium P is cut to the needed size from a continuous sheet (rolled sheet) and is fed.

The processing liquid applying section 114 is a mechanism that applies processing liquid to the recording surface of the recording medium P. The processing liquid contains an agglomerating agent that agglomerates components within the ink compositions that are applied at the image drawing section 116. Due to the processing liquid and the ink contacting, an agglomerating reaction with the ink is caused, separation of the color material and the solvent of the ink is promoted, and formation of a high quality image is possible without bleeding or landing interference (uniting) or color mixing after landing of the ink arising. Note that the processing liquid can be structured by using other components as needed, in addition to the agglomerating agent. By using the processing liquid together with the ink composition, the inkjet recording can be made to be high speed, and, even with the high speed recording, an image having high density and high resolution and that is drawn excellently (e.g., in which the reproduction of fine lines and extremely detailed portions is excellent) is obtained.

As shown in FIG. 1, the processing liquid applying section 114 has a sheet feeding cylinder 152, a processing liquid drum 154, and a processing liquid coating device 156. The processing liquid drum 154 is a drum that holds the recording medium P and rotates and conveys the recording medium P. Claw-shaped holding means (grippers) 155 are provided at the outer peripheral surface of the processing liquid drum 154, and the leading end of the recording medium P can be held by the recording medium P being nipped-in between the claws of the holding means 155 and the peripheral surface of the processing liquid drum 154. Suction holes may be provided in the outer peripheral surface of the processing liquid drum 154, and a suction means for carrying out suction from the suction holes may be connected thereto. Due thereto, the recording medium P can be held tightly to the peripheral surface of the processing liquid drum 154.

The processing liquid coating device 156 is provided at the outer side of the processing liquid drum 154 so as to face the peripheral surface thereof. The processing liquid is coated onto the recording surface of the recording medium P by the processing liquid coating device 156.

The recording medium P, to which the processing liquid has been applied at the processing liquid applying section 114, is transferred from the processing liquid drum 154 via an intermediate conveying section 126 (first transfer cylinder conveying means) to the image drawing drum 170 of the image drawing section 116.

The image drawing section 116 has the image drawing drum 170 and the inkjet heads 172M, 172K, 172C, 172Y. Although not shown in FIG. 1, a sheet pressing roller, for removing wrinkles of the recording medium P, may be disposed at the side before the inkjet heads 172M, 172K, 172C, 172Y, with respect to the image drawing drum 170.

In the same way as the processing liquid drum 154, the image drawing drum 170 has claw-shaped holding means (grippers) 171 at the outer peripheral surface thereof, and holds and fixes the leading end portion of the recording medium. Further, the image drawing drum 170 has plural suction holes in the outer peripheral surface thereof, and the recording medium P is attracted to the outer peripheral surface of the image drawing drum 170 by negative pressure. Due thereto, contact of the recording medium P with the heads due to floating-up of the recording medium P is avoided, and paper jamming is prevented. Further, non-uniformity of the image due to fluctuations in clearance between the recording medium P and the heads is prevented.

The recording medium P that is fixed to the image drawing drum 170 in this way is conveyed with the recording surface thereof facing outward, and aqueous inks, that contain thermoplastic resin and color materials, are ejected onto this recording surface from the inkjet heads 172M, 172K, 172C, 172Y.

Each of the inkjet heads 172M, 172K, 172C, 172Y is a full-line-type inkjet recording head (inkjet head) having a length that corresponds to the maximum width of the image formation region at the recording medium P. Nozzle rows, at which plural nozzles for ejecting ink are arrayed, are formed at the ink ejecting surface of each of the inkjet heads 172M, 172K, 172C, 172Y, over the entire width of the image formation region. Each of the inkjet heads 172M, 172K, 172C, 172Y is set so as to extend in a direction orthogonal to the conveying direction of the recording medium P (the rotating direction of the image drawing drum 170).

Droplets of inks of corresponding colors are ejected from the respective inkjet heads 172M, 172K, 172C, 172Y toward the recording surface of the recording medium P that is held tightly on the image drawing drum 170. Due thereto, the inks contact the processing liquid, that was applied in advance to the recording surface at the processing liquid applying section 114, and the color materials (pigments) dispersed within the inks agglomerate, and agglomerates of the color materials are formed. Flowing of color materials on the recording medium P, and the like, are thereby prevented, and an image is formed on the recording surface of the recording medium P.

Note that, in the present example, the reference colors (four colors) of CMYK are given as an example, but the combination of the ink colors and the number of colors is not limited to that of the present exemplary embodiment, and light inks, dark inks, and inks of specific colors may be added as needed. For example, a structure to which is added an inkjet head that ejects a light ink such as light cyan, light magenta or the like, also is possible. Further, the order in which the heads of the respective colors are arranged also is not particularly limited.

Image drawing can be carried out in a single pass on the recording medium P by the image drawing section 116 that is structured as described above. Due thereto, high-speed recording and high-speed output are possible, and the mass produceability can be improved.

The recording medium P, on which an image is formed at the image drawing section 116, is transferred from the image drawing drum 170 via an intermediate conveying section 128 (second transfer cylinder conveying means) to a drying drum 176 of the drying section 118.

The drying section 118 is a mechanism that dries the moisture contained in the solvent that separated due to the color material agglomerating action. As shown in FIG. 1, the drying section 118 has the drying drum 176 and a solvent drying device 178. In the same way as the processing liquid drum 154, the drying drum 176 has claw-shaped holding means (grippers) 177 at the outer peripheral surface thereof, and holds the leading end of the recording medium P by the holding means 177. Further, the drying drum 176 has suction holes (not shown) in the drum outer peripheral surface, and the recording medium P can be attracted to the drying drum 176 by negative pressure. Moreover, air blowing means 180 (attraction assisting means) and the solvent drying device 178 are provided so as to face the outer peripheral surface of the drying drum 176.

The air blowing means 180 is for assisting the attraction of the recording medium P to the drying drum 176. The air blowing means 180 blows-out air obliquely toward the transverse direction end portion sides of the recording medium P, such that the recording medium P, whose distal end is held by the holding means 177, is reliably attracted from the leading end side toward the trailing end side thereof, without wrinkles arising therein.

The solvent drying device 178 is disposed at a position facing the outer peripheral surface of the drying drum 176, and is structured by hot air drying means 182 at which plural combinations of an IR heater or the like and a fan are disposed. Various drying conditions can be realized by appropriately adjusting the temperature and the air volume of the hot air that is blown-out toward the recording medium P from respective hot air blow-out nozzles of the hot air drying means 182. The recording medium P is conveyed while being attracted to and restrained at the outer peripheral surface of the drying drum 176 such that the recording surface thereof faces the outer side, and drying processing by the aforementioned IR heaters and warm air blow-out nozzles is carried out with respect to the recording surface.

Suction holes are provided in the outer peripheral surface of the drying drum 176, and the drying drum 176 has a suction means that carries out suction from these suction holes. The recording medium P can thereby be tightly held at the peripheral surface of the drying drum 176. Further, cockling of the recording medium P can be prevented because the recording medium P can be restrained at the drying drum 176 by carrying out negative pressure suction.

The recording medium P, on which drying processing has been carried out at the drying section 118, is transferred from the drying drum 176 via an intermediate conveying section 130 (third transfer cylinder conveying means) to a fixing drum 184 of the fixing section 120.

The fixing section 120 is structured by the fixing drum 184 and a pressing roller 188 (smoothing means). In the same way as the processing liquid drum 154, the fixing drum 184 has claw-shaped holding means (grippers) 185 at the outer peripheral surface thereof, and can hold the leading end of the recording medium P by the holding means 185.

Due the rotation of the fixing drum 184, the recording medium P is conveyed with the recording surface thereof facing outward, and smoothing processing and fixing by the pressing roller 188 are carried out on this recording surface.

Due to the pressing roller 188 applying pressure to the recording medium P on which the inks have dried, the pressing roller 188 carries out smoothing of the recording medium P and fixing of the inks.

Note that an in-line sensor that carries out inspection of the image formed on the recording medium P may be provided so as to face the outer peripheral surface of the fixing drum 184. The in-line sensor is a measuring means for measuring a check pattern and the moisture content, surface temperature, degree of gloss, and the like of the image fixed on the recording medium P, and, for example, a CCD line sensor can suitably be used therefor.

As will be described later, a matting liquid coating section 80 is provided at the pressing roller 188, and supplies a matting liquid 200L to the outer peripheral surface of the pressing roller 188. At the matting liquid coating section 80, a web 82, that is seeped with the matting liquid 200L that is formed from a liquid (silicon oil or the like) in which matting agent particles 200P are dispersed at a predetermined concentration, is trained around a first rod 84A and a second rod 84B, and is made to abut the pressing roller 188 while running along the outer peripheral surface thereof, and transfers the matting liquid 200L once onto the outer peripheral surface of the pressing roller 188, and again transfers the matting agent particles 200P, that have adhered to the roller surface, onto the surface of the recording medium P.

Due thereto, the recording medium P, that is in a state in which the matting agent particles 200P have been applied to the surface thereof, is conveyed to the sheet discharging section 122. Blocking (bonding) of the recording media P at the time when a large number of the recording media P are in a stacked state within a sheet discharging unit 192 is prevented.

The sheet discharging section 122 is provided following these. The sheet discharging unit 192 is set at the sheet discharging section 122. A transfer cylinder 194 and a conveying chain 196 are provided from the fixing drum 184 of the fixing section 120 to the sheet discharging unit 192. The conveying chain 196 is trained around a tension roller 198. The recording medium P that has passed the fixing drum 184 is sent, via the transfer cylinder 194, to the conveying chain 196, and is transferred from the conveying chain 196 to the sheet discharging unit 192.

Although not shown in FIG. 1, the inkjet recording device 100 of the present example has, in addition to the above-described structures, ink storage/filling sections that supply inks to the respective inkjet heads 172M, 172K, 172C, 172Y, and means that supplies the processing liquid to the processing liquid applying section 114. The inkjet recording device 100 also has head maintenance sections that carry out cleaning (wiping of the nozzle surfaces, purging, suctioning of nozzles, and the like) of the respective inkjet heads 172M, 172K, 172C, 172Y, position detecting sensors that detect the position of the recording medium P on the sheet conveying path, temperature sensors that detect the temperatures of the respective sections of the device, and the like.

<Details of Respective Sections>

Figure 2:
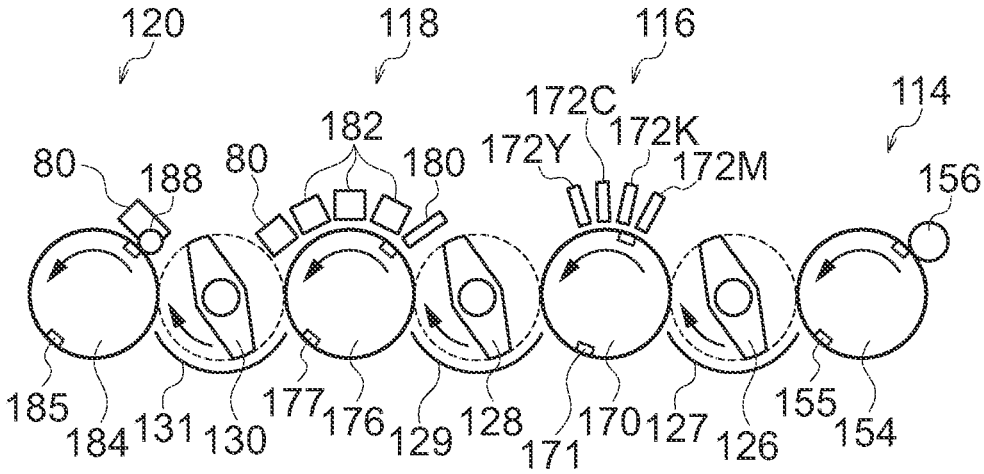
FIG. 2 is a schematic drawing showing main portions of the image recording device relating to the exemplary embodiment of the present invention.

The processing liquid applying section 114, the image drawing section 116, the drying section 118 and the fixing section 120, that are the main portions of the inkjet recording device 100 of the present exemplary embodiment, are shown in an enlarged manner in FIG. 2. The inkjet recording device relating to the present invention is described in further detail.

As shown in FIG. 2, the processing liquid drum 154, the intermediate conveying section 126 (first transfer cylinder conveying means), the image drawing drum 170, the intermediate conveying section 128 (second transfer cylinder conveying means), the drying drum 176, the intermediate conveying section 130 (third transfer cylinder conveying means), and the fixing drum 184 are disposed so as to be lined-up. The recording medium P is conveyed by these respective drums, and, while being conveyed, processing liquid application, image drawing, drying and fixing are carried out in that order thereon.

The respective intermediate conveying sections (the first transfer cylinder conveying means 126, the second transfer cylinder conveying means 128, the third transfer cylinder conveying means 130) have ribbed guiding members 127, 129, 131, respectively, and rotate around the rotation axes thereof while holding claws (not illustrated), that are at the distal end portions of arms that extend in directions facing one another at 180° apart with the rotation axis therebetween, grasp the leading end portion of the recording medium P. With the trailing end portion of the recording medium P in a free state, the intermediate conveying sections 126, 128, 130 convey the recording medium P along the respective guiding members (127, 129, 131), such that the reverse surface side of the recording surface is convex.

Note that the intermediate conveying sections 126, 128, 130 may be structured so as to grasp the recording medium P by using chain grippers, and convey the recording medium P with the reverse surface side thereof being convex.

The inkjet recording device 100 of the present exemplary embodiment records an image on the recording surface of the recording medium P. The recording medium P is not particularly limited, and general printing papers, that are used in general offset printing and the like and whose main component is cellulose such as so-called high-grade paper, coated paper, art paper or the like, can be used. At a general printing paper whose main component is cellulose, in image recording by a general inkjet method that uses aqueous ink, relatively, the absorption of ink and drying are slow, it is easy for movement of the color material after droplet ejection to occur, and it is easy for image quality to deteriorate. However, in the inkjet recording device 100 of the present exemplary embodiment, owing to agglomeration, movement of the color material is suppressed, and high-quality image recording of excellent color density and hue is possible.

Among recording media, so-called coating-processed papers that are used in general offset printing and the like are preferable. Coating-processed paper is paper in which a coating layer is provided by coating a coating agent onto the surface of high-grade paper or acid-free paper or the like whose main component is cellulose and that generally has not been surface treated. With coating-processed papers, in image formation by usual aqueous ink jetting, it is easy for problems to arise with respect to quality, such as the gloss or rub-fastness or the like of the image. However, in the inkjet recording device 100 of the present exemplary embodiment, non-uniform gloss is suppressed, and an image having good gloss and rub-fastness can be obtained. In particular, it is preferable to use a coating-processed paper having a base paper and a coating layer that contains an inorganic pigment, and it is more preferable to use a coating-processed paper having a base paper and a coating layer that contains kaolin and/or calcium bicarbonate. Concretely, art paper, coated paper, light-weight coated paper, and finely coating-processed paper are more preferable.

As described above, the processing liquid applying section 114 applies processing liquid onto the recording surface of the recording medium P.

The film thickness of the processing liquid that is coated on the recording surface by the processing liquid coating device 156 is desirably sufficiently smaller than the droplet diameter of the inks that are ejected from the inkjet heads 172M, 172K, 172C, 172Y of the image drawing section 116. For example, when the ejected amount of the ink is 2 pl (picoliters), the average diameter of the droplet is 15.6 μm. At this time, when the film thickness of the processing liquid is thick, the ink dots float within the processing liquid without contacting the surface of the recording medium P. Thus, it is desirable to make the film thickness of the processing liquid be less than or equal to 3 μm in order to obtain a landed dot diameter of greater than or equal to 30 μm when the ejected amount of the ink is 2 pl.

The processing liquid coating device 156 is mainly structured by a processing liquid container, a metering roller, and a coating roller (none of which is illustrated). The processing liquid is stored in the processing liquid container, and a portion of the metering roller is immersed in this processing liquid. A metal roller or an anilox roller, in which numerous cells are formed orderly in a given number of lines in a roller peripheral surface that is formed by coating a ceramic on the surface of a metal roller, is suitably used as the metering roller. Iron or stainless-steel or the like is used as the material of the metal roller. When iron is used as the material, in order to improve the hydrophilic nature of the surface and improve the wear-resistance and the rust-proof ability, plating, such as chrome plating or the like, may be carried out on the surface. As the cell structure of the anilox roller, for example, a structure having a number of lines of greater than or equal to 150 lines and less than or equal to 400 lines, a cell depth of greater than or equal to 20 μm and less than or equal to 75 μm, and a cell volume of greater than or equal to 30 $cm^3/m^2$ and less than or equal to 60 $cm^3/m^2$ can suitably be used. The diameter of the metering roller is formed to be, for example, greater than or equal to 20 mm and less than or equal to 100 mm.

The metering roller is supported so as to rotate freely, and is connected to an unillustrated motor, and is driven to rotate at a given speed. Accordingly, the processing liquid within the processing liquid container adheres to the surface of the metering roller, and this processing liquid can be transferred onto the surface of the coating roller. The rotating direction of the metering roller is the same direction as that of the coating roller, and the peripheral speed of the roller outer periphery is the same as that of the coating roller, or a difference in speeds may be provided therebetween. When a difference in speeds is provided, it is suitable for the peripheral speed of the metering roller to be greater than or equal to 80% and less than or equal to 140% of the peripheral speed of coating roller. By adjusting the peripheral speeds of the coating roller and the metering roller, the transfer rate from the metering roller to the coating roller can be adjusted, and the film thickness coated onto the recording medium P can be adjusted.

A doctor blade for metering is provided so as to abut the surface of the metering roller. The doctor blade is disposed at the upstream side, in the rotating direction of the metering roller, with respect to the position of contact between the metering roller and the coating roller, and can meter the coating liquid by scraping-off coating liquid that is on the surface of the metering roller. Due thereto, the coating liquid metered by the doctor blade can be supplied to the coating roller.

A rubber roller having, at the surface thereof, a rubber layer of EPDM or silicon or the like is suitably used as the coating roller. The coating roller is supported so as to rotate freely, and is connected to an unillustrated motor, and is driven to rotate at a given speed. The rotating direction of the coating roller is the same direction as that of the processing liquid drum 154, and the peripheral speed of the roller outer periphery also is the same speed as that of the processing liquid drum 154. Due thereto, the processing liquid, that has been transferred from the metering roller onto the coating roller, is coated on the recording medium P that is held on the processing liquid drum 154.

Because the processing liquid coating device 156 coats the processing liquid by a roller in this way, the processing liquid can be coated onto the recording medium P uniformly and in a small coated amount. Further, it is preferable for the roller of the processing liquid coating means to be made to contact and made to move away at each recording medium, in order for the processing liquid coating device 156 to not dirty the conveying drum for the processing liquid coating (the processing liquid drum 154). The processing liquid drum 154 conveys the recording medium P by the holding claws that hold the leading end of the recording medium P. Due thereto, high-speed conveying of the recording medium P is possible, and the occurrence of sheet conveying jams can be reduced.

Note that IR heaters and warm air blow-out nozzles may be provided at the outer periphery of the processing liquid drum 154 so as to face the peripheral surface thereof, and may dry the processing liquid that is coated on the recording medium P. When IR heaters and warm air blow-out nozzles are provided, the IR heaters are controlled to a high temperature (e.g., 180° C.), and the warm air blow-out nozzles blow-out warm air of a high temperature (e.g., 70° C.) toward the recording medium P at a given air volume (e.g., 9 $m^3$/minute). Due to the heating by these IR heaters and warm air blow-out nozzles, the moisture within the solvent of the processing liquid is evaporated, and a thin film layer of the processing liquid is formed on the recording surface of the recording medium P. By forming the processing liquid into a thin layer in this way, the dots of ink that are ejected at the image drawing section 116 contact the recording surface of the recording medium P, and the necessary dot diameter is obtained, and further, it is easy to obtain the action of the ink reacting with the processing liquid components that have been made into a thin layer, agglomeration of the color material occurring, and the ink being fixed to the recording surface of the recording medium P. Note that the processing liquid drum 154 may be controlled to be a predetermined temperature (e.g., 50° C.).

The processing liquid contains an agglomerating agent that agglomerates components within the ink composition that is applied at the image drawing section 116. The agglomerating agent may be a component that can change the pH of the ink composition, or a polyvalent metal salt, or a polyarylamine. In the present exemplary embodiment, from the standpoint of the ability to agglomerate the ink composition, a compound that can change the pH of the ink composition is preferable, and a compound that can lower the pH of the ink composition is more preferable. Suitable examples of compounds that can lower the pH of the ink composition are highly water-soluble acidic substances (phosphoric acid, oxalic acid, malonic acid, citric acid, or derivatives of these compounds or salts thereof or the like).

In this way, a highly water-soluble acidic substance is preferable as the agglomerating agent, and, from the standpoints of improving the agglomerating ability and fixing the ink overall, organic acids are preferable, and organic acids that are greater than or equal to bivalent are more preferable. Moreover, acidic substances that are greater than or equal to bivalent and less than or equal to trivalent are particularly preferable. As organic acids that are greater than or equal to bivalent, organic acids whose first pKa is less than or equal to 3.5 are preferable, and organic acids whose first pKa is less than or equal to 3.0 are more preferable. Concretely, phosphoric acid, oxalic acid, malonic acid, citric acid, and the like are suitable examples.

In the agglomerating agent, a single type of acidic substance alone may be used, or two or more types may be used in combination. Due thereto, the agglomerating ability improves, and the ink overall can be fixed. The content, within the processing liquid, of the agglomerating agent that agglomerates the ink composition is preferably 1 to 50% by mass, and more preferably 3 to 45% by mass, and even more preferably 5 to 40% by mass. Further, it is preferable that the pH (25° C.) of the ink composition is greater than or equal to 8.0, and that the pH (25° C.) of the processing liquid is within the range of 0.5 to 4. Due thereto, good image density, good resolution, and high-speed inkjet recording can be achieved.

Further, the processing liquid can contain other additives. Examples of other additives are known additives such as drying preventing agents (wetting agents), color fading preventing agents, emulsion stabilizers, penetration accelerating agents, ultraviolet absorbing agents, preservatives, antifungal agents, pH adjusting agents, surface tension adjusting agents, defoaming agents, viscosity adjusting agents, dispersing agents, dispersion stabilizers, rust-proofing agents, chelating agents, and the like.

As described above, in the present exemplary embodiment, a structure that utilizes a coating method by a roller is given as an example, but the applying of the processing liquid is not limited to a coating method, and can be carried out by utilizing a known method such as an inkjet method, an immersion method, or the like. Note that the coating method can be carried out by a known coating method using a bar coater, an extrusion die coater, an air doctor coater, a blade coater, a rod coater, a knife coater, a squeeze coater, a reverse roll coater, or the like.

The processing liquid applying step may be provided either before or after the ink applying step that uses an ink composition. In the present exemplary embodiment, an aspect in which the ink applying step is provided after the processing liquid is applied in the processing liquid applying step is preferable. Concretely, an aspect is preferable in which, before an ink composition is applied on the recording medium P, a processing liquid for agglomerating the pigments within the ink composition and/or particles of a self-dispersing polymer is applied in advance, and the ink composition is applied so as to contact the processing liquid that has been applied on the recording medium P, and an image is formed. Due thereto, the inkjet recording can be made to be high speed, and, even with high speed recording, an image having high density and resolution can be obtained.

The applied amount of the processing liquid is not particularly limited provided that it can cause the ink composition to agglomerate, but preferably can be made to be an amount that is such that the applied amount of the agglomerating agent becomes greater than or equal to 0.1 g/$m^2$. Thereamong, an amount that is such that the applied amount of the agglomerating agent becomes 0.2 to 0.7 g/$m^2$ is preferable. When the applied amount of the agglomerating agent is greater than or equal to 0.1 g/$m^2$, a good, high-speed agglomerating ability is maintained in accordance with various forms of usage of the ink composition. Further, making the applied amount of the agglomerating agent be less than or equal to 0.7 g/$m^2$ is preferable with regard to the point that the surface property of the recording medium to which the agglomerating agent is applied is not adversely affected (the gloss does not change, and the like).

In the processing liquid applying section 114, the processing liquid is, by the processing liquid coating device 156, coated on the recording medium P while being metered, while the recording medium P is conveyed with the leading end portion thereof held by the holding means 155 that is provided at the outer peripheral surface of the processing liquid drum 154.

The recording medium P, to which the processing liquid has been applied at the processing liquid applying section 114, is conveyed by the intermediate conveying section (first transfer cylinder conveying means) 126 to the subsequent image drawing section 116. The recording medium P is conveyed with the leading end portion thereof held by the holding claws (not shown) of the first transfer cylinder conveying means 126, and with the recording surface thereof facing toward the inner side, and with the reverse side thereof forming a convex shape along the guiding member 127.

Further, the first transfer cylinder conveying means 126 has a hot air drying means (not illustrated) at the interior thereof (in a vicinity of the rotational axis), and causes hot air to hit the recording surface (obverse) side of the recording medium P that is facing toward the inner side during the conveying, and dries the processing liquid that has been applied to the obverse. Due thereto, when ink is ejected onto the recording medium P at the image drawing section 116, movement of ink that has landed on the recording medium P at the time of adhering of the ink is prevented.

At the image drawing drum 170 of the image drawing section 116, the leading end portion of the recording medium P, that has been conveyed-in by the first transfer cylinder conveying means 126, is held by the holding means 171 provided at the outer peripheral surface of the image drawing drum 170, and the recording medium P is conveyed while being attracted and fixed to the outer peripheral surface of the image drawing drum 170 by the suction holes provided in the outer peripheral surface of the image drawing drum 170. Further, aqueous inks, that contain thermoplastic resin and color materials, are ejected from the inkjet heads 172M, 172K, 172C, 172Y toward the obverse (recording surface), to which the processing liquid has been applied, of the recording medium P that is fixed on the outer peripheral surface of the image drawing drum 170.

<Image Drawing Section>

In the image drawing section 116 shown in FIG. 2, droplets of corresponding color inks are ejected from the respective inkjet heads 172M, 172K, 172C, 172Y toward the recording surface of the recording medium P that is held tightly on the image drawing drum 170. The inks thereby contact the processing liquid, that was applied in advance to the recording surface at the processing liquid applying section 114, and the color materials (pigments) dispersed in the inks are agglomerated, and color material agglomerates are formed. Due thereto, flowing of color material on the recording medium P, and the like, are prevented, and an image is formed on the recording surface of the recording medium P.

Note that, from the standpoint of obtaining a highly-detailed image, the droplet amount of the ink that is ejected from each of the inkjet heads 172M, 172K, 172C, 172Y is preferably 1 to 10 pl (picoliters), and more preferably 1.5 to 6 pl. Further, from the standpoint of overcoming non-uniformity of the image and improving the connections between the continuous gradations, ejecting the droplets in a combination of different droplet amounts is also effective, and the present invention is suitably applied to such a case as well.

Note that, in the present example, the reference colors (four colors) of CMYK are given as an example, but the combination of the ink colors and the number of colors is not limited to that of the present exemplary embodiment, and light inks, dark inks, and inks of specific colors may be added as needed. For example, a structure to which is added an inkjet head that ejects a light ink such as light cyan, light magenta or the like, also is possible. Further, the order in which the heads of the respective colors are arranged also is not particularly limited.

Image drawing can be carried out in a single pass on the recording medium P by the image drawing section 116 that is structured in this way.

<Drying Section>

The recording medium P, on which an image has been formed at the image drawing section 116, is transferred from the image drawing drum 170 via the intermediate conveying section (second transfer cylinder conveying means) 128 to the drying drum 176 of the drying section 118. The second transfer cylinder conveying means 128 conveys the recording medium P, that has been transferred from the image drawing drum 170, with the leading end portion of the recording medium P being held by holding claws (not shown), and with the recording surface of the recording medium P facing toward the inner side, and with the reverse side thereof forming a convex shape along the guiding member 129.

Note that the second transfer cylinder conveying means 128 may be structured to have an unillustrated hot air drying means (drying means) at the interior thereof, and blow-out hot air toward the recording surface side of the recording medium P that is facing toward the inner side during the conveying, and dry the ink that has been ejected onto the obverse. Due thereto, the ink can be dried immediately after being ejected. Therefore, it becomes easy to reduce cockling of the recording medium P that is due to ink penetration, and it becomes easy to suppress the occurrence of wrinkles due to attraction at the time when the recording medium P is restrained by suction at the drying drum 176 of the drying section 118.

The drying section 118 is a mechanism that dries the moisture that is contained in the solvent dispersed by the color material agglomerating action. The drying drum 176 and the hot air drying means 182, at which plural combinations of an IR heater or the like and a fan are disposed at positions facing the outer peripheral surface of the drying drum 176, are provided at the drying section 118.

The air blowing means 180 (attraction assisting means) is provided at the upstream side (in the rotating direction of the drying drum 176) of the plural hot air drying means 182, so as to face the outer periphery of the drying drum 176.

In the same way as the processing liquid drum 154, the drying drum 176 has the claw-shaped holding means (grippers) 177 at the outer peripheral surface thereof, and can hold the leading end of the recording medium P by the holding means 177. Further, the drying drum 176 has plural suction holes in the outer peripheral surface thereof, and the recording medium P is attracted to the outer peripheral surface of the drying drum 176 by negative pressure, and is conveyed while being restrained at and fit tightly to the outer peripheral surface. Hot air from the hot air blow-out nozzles of the hot air drying means 182 hits the recording medium P, that is restrained at the drying drum 176 in this way, and dries the recording medium P.

The occurrence of cockling is thereby prevented. Further, by making the recording medium P tightly contact the drying drum 176 outer peripheral surface, the occurrence of jamming and paper burning due to the recording medium P contacting the hot air drying means 182 can be prevented.

The hot air blow-out nozzles of the hot air drying means 182 are structured so as to blow-out a given volume of warm air, that is controlled to a predetermined temperature, toward the recording medium P, and the IR heaters are respectively controlled to a predetermined temperature. Due to these hot air blow-out nozzles and IR heaters, the moisture contained in the recording surface of the recording medium P that is held at the drying drum 176 is evaporated, and drying processing is carried out. At this time, the drying drum 176 of the drying section 118 is separated, in terms of structure, with respect to the drying drum 170 of the image drawing section 116, and therefore, at the inkjet heads 172M, 172K, 172C, 172Y, poor ejection of ink caused by drying of the head mechanism portions due to heat drying can be reduced. Further, there are degrees of freedom in setting the temperature of the drying section 118, and the optimal drying temperature can be set.

Note that it is preferable that the evaporated moisture be exhausted together with air to the exterior of the device by an unillustrated exhaust means. Further, the recovered air may be cooled by a cooler (radiator) or the like, and recovered as a liquid.

Further, it is preferable that the outer peripheral surface of the drying drum 176 be controlled to a predetermined temperature. By carrying out heating from the reverse surface of the recording medium P, drying is accelerated, and image destruction at the time of fixing can be prevented.

The range of the surface temperature of the drying drum 176 is preferably greater than or equal to 50° C., and more preferably greater than or equal to 60° C. The upper limit is not particularly limited, but is preferably set to less than or equal to 75° C. from the standpoint of safety (prevention of burns due to high temperatures) in maintenance work such as the cleaning of ink that has adhered to the surface of the drying drum 176 and the like.

It is preferable that the drying drum 176 be heated to a predetermined temperature before the recording medium P is conveyed. By heating the drying drum 176 in advance, drying can be accelerated, and therefore, image destruction is prevented and cockling can be prevented. The heating temperature is preferably made to be the same temperature range as that of the above-described surface temperature of the drying drum 176.

It is preferable that the drying drum 176 be heated to a predetermined temperature in the state in which suction is being carried out, in order to prevent a drop in temperature at the time of suction. Further, if heating is carried out without suction being carried out, in consideration of a drop in temperature at the time when suction is carried out, it is preferable to heat the drying drum 176 to become a temperature higher than the predetermined temperature. Further, by carrying out drying while rotating and conveying the recording medium P with the recording medium P held such that the recording surface thereof faces outward (i.e., in a state in which the recording surface of the recording medium P is curved so as to become the convex side), the occurrence of wrinkles and floating-up of the recording medium P can be prevented, and non-uniform drying due thereto can reliably be prevented.

The air blowing means 180 (attraction assisting means) that is provided at the upstream side of the hot air drying means 182 is for assisting the attraction of the recording medium P to the drying drum 176. The air blowing means 180 blows air in an oblique direction toward the trailing end side of the recording medium P, and control is carried out such that the air hits the recording medium P obliquely toward the transverse direction end portion sides thereof and the force of the air becomes greater at the trailing end. Due thereto, floating-up of the sheet at the trailing end of the recording medium P is prevented, wrinkling of the recording medium P due to attraction is removed, and uniform drying and uniform attraction are made possible. In this way, by using the air blowing means 180 that is an attraction assisting means that does not contact the recording medium P, it is possible to prevent ink, that has not yet dried on the recording medium P, from being transferred to a contacting means and image defects from arising as in the case of assisting attraction by using a contacting means.

The suction force of the drying drum 176 can be expressed as "opening surface area"×"pressure per unit surface area". The suction force can be increased by increasing the surface area occupied by the suction holes at the region where the recording medium is attracted and held, i.e., the opening rate.

It is preferable that the opening rate of the suction holes provided at the outer peripheral surface of the drying drum 176 be greater than or equal to 1% and less than or equal to 75% of the contact surface area between the outer peripheral surface of the drying drum 176 and the recording medium P. If the opening rate is less than 1%, expansion deformation of the recording medium due to moisture absorption after recording cannot be sufficiently suppressed. Further, although drying is promoted by warming the drying drum 176 itself and by the recording medium P contacting the drying drum 176, if the opening rate is greater than 75%, the contact surface area between the reverse surface of the recording medium P and the outer peripheral surface of the drying drum 176 decreases. Therefore, even in the state in which the recording medium P is attracted and held, a sufficient drying performance cannot be achieved, and there is the concern that cockling also will worsen.

Accordingly, by making the opening rate of the suction holes at the outer peripheral surface of the drying drum 176 be greater than or equal to 1% and less than or equal to 75%, suppression/prevention of cockling and improvement of the drying performance can be achieved.

Note that the opening rate is set by the diameter of the suction holes, the hole pitch, and the shape and arrangement of the holes. It is preferable that the hole diameter be set to be greater than or equal to 0.4 mm, and so that traces of indentations (traces of the attraction) due to the negative pressure attraction are not formed in the recording medium P, be set to be less than or equal to 1.5 mm. The hole pitch is preferably greater than or equal to 0.1 mm and less than or equal to 5 mm in order to prevent heat deformation and ensure rigidity of the outer peripheral surface of the drying drum 176. If the intervals between the holes are too large, the effect of suppressing deformation of the recording medium is insufficient, and the occurrence of wrinkles cannot be suppressed that much. Further, when the shapes of the suction holes are angular (acute angular), stress concentrates at the corner portions, and therefore, a shape in which the corner portions are rounded is preferable.

At the rotating conveying body, the amount of deformation of the recording medium P due to the attraction pressure is greater in the axial direction than in the peripheral direction. Accordingly, by forming the suction holes in oval shapes or elongated hole shapes whose long axis directions are the peripheral direction and whose short axis directions are the axial direction, the deformation in the peripheral direction and the deformation in the axial direction of the recording medium P can be made to be uniform.

Due to the recording medium P being dried while being rotated and conveyed while being held at the outer peripheral surface of the drying drum 176 with the recording surface of the recording medium P facing outward (i.e., in a state in which the recording surface of the recording medium P is curved so as to become the convex side), the occurrence of wrinkles and floating-up of the recording medium P can be prevented, and non-uniform drying caused thereby can be reliably prevented.

A flow adjusting plate 181 is formed at the upper side of each of the hot air drying means 182, so as to cover the hot air drying means 182 and such that the hot air blown-out from the hot air drying means 182 is again directed toward the drying drum 176 side. Here, it is good to further provide a guide plate 183 at the drying drum 176 rotating direction downstream side of each of the hot air drying means 182 such that the hot air, that has been blown-out from the respective hot air drying means 182 and has once hit the surface of the drying drum 176, is made to flow so as to again be directed toward the drying drum 176 side. By providing the flow adjusting plates 181 in this way, the heat efficiency is improved, and an improvement in the exhausting ability also can be achieved.

Further, a temperature sensor (not shown) and a humidity sensor are provided within the drying section 118, and the detected temperature and humidity are sent as data to an unillustrated control section. The on/off state or the air volume of the hot air drying means 182 may be controlled on the basis of this temperature and humidity information. Further, the total amount of ink that has been ejected onto the recording medium P, i.e., the ejection density, may be used in controlling the hot air drying means 182. The ejection density is the amount of ink ejected per one recording medium P, and can be computed as data from the contents of the image or the pattern or the like that is recorded.

<Fixing Section>

The recording medium P, on which drying processing has been carried out at the drying section 118, is transferred from the drying drum 176 via the intermediate conveying section (third transfer cylinder conveying means 130) to the fixing drum 184 of the fixing section 120.

When the fixing drum 184 receives the recording medium P from the third transfer cylinder conveying means 130, the leading end portion of the recording medium P is held by the holding means 185 provided at the outer peripheral surface of the fixing drum 184, and the recording medium P is trained around the outer peripheral surface of the fixing drum 184 and conveyed.

The recording medium P, that is conveyed while trained around the outer peripheral surface of the fixing drum 184, is pressurized by the pressing roller (smoothing means) 188, that is disposed so as to face the fixing drum 184, and is pressed against the fixing drum 184 such that curling of the recording medium P is corrected and wrinkles are removed.

The pressing roller 188 is disposed so as to press-contact the fixing drum 184, and structures nip rollers together with the fixing drum 184. Due thereto, the recording medium P is sandwiched between the pressing roller 188 and the fixing drum 184, is nipped at a predetermined nipping pressure (e.g., 0.15 MPa), and smoothing processing is carried out thereon.

The pressing roller 188 may be a heating roller. For example, the pressing roller 188 may be structured as a heating roller in which a halogen lamp is assembled within a pipe made of a metal having good thermoconductivity such as aluminum or the like, and may be controlled to a predetermined temperature (e.g., 60 to 80° C.). Due to the recording medium P being heated and pressed by the pressing roller 188 that is structured as a heating roller, thermal energy of greater than or equal to the Tg temperature (glass transition temperature) of the latex contained in the ink is applied, the latex particles are fused, unevenness of the image surface of the recording medium P is leveled, and glossiness is obtained.

<Matting liquid Coating Section>

The matting liquid coating section relating to the present exemplary embodiment is shown in FIGS. 3 through 7. In the matting liquid supplying method of the present invention, the matting liquid coating section 80 supplies the matting liquid 200L to the outer peripheral surface of the pressing roller 188 as described above. At the matting liquid coating section 80, the web 82, that is a non-woven fabric or the like and that is seeped with the matting liquid 200L that is formed from a liquid (silicon oil or the like) in which the matting agent particles 200P are dispersed at a predetermined concentration, is trained around the first rod 84A and the second rod 84B, and is made to abut the pressing roller 188 so as to run along the outer peripheral surface thereof, and the matting liquid 200L is transferred once to the outer peripheral surface of the pressing roller 188, and the matting agent particles 200P, that have adhered to the roller surface, are transferred again onto the surface of the recording medium P.

Due thereto, the recording medium P, that is in a state in which the matting agent particles 200P are applied to the surface thereof, is conveyed to the sheet discharging section 122. Blocking (bonding) at the time when a large number of the recording media are stacked within the sheet discharge unit 192 is prevented.

It suffices for the web 82 (application strip material) to be strip-shaped and to be able to hold a liquid, such as being fibrous or porous or the like, such as a fabric or a non-woven fabric or the like. A void pore diameter R of the web 82 is defined as follows. Basis weight M, thickness T, and fiber radius r are parameters characteristic of the web 82.

R: void pore diameter (μm)

$$R=2\times\sqrt{(S/\pi)}$$

S: void sectional area ($\mu m^2$)

$$S=K/N\times 106$$

K: void rate

N: number of fibers per one $\mu m^2$ of impregnation material cross-section (number/$\mu m^2$)

M: basis weight ($g/m^2$)

T: thickness (μm)

r: fiber radius (μm)

$$K=1-M/T$$

$$N=(1-K)/(\pi r^2\times 106)$$

Various material such as, for example, acrylic resin powder, starch powder, PVA, and the like can be considered for the matting agent particles 200P. Powders of an average particle diameter of around 5 to 50 μm are suitable, and more desirably, powders of an average particle diameter of around 10 to 30 μm can be suitably used.

Figure 3:
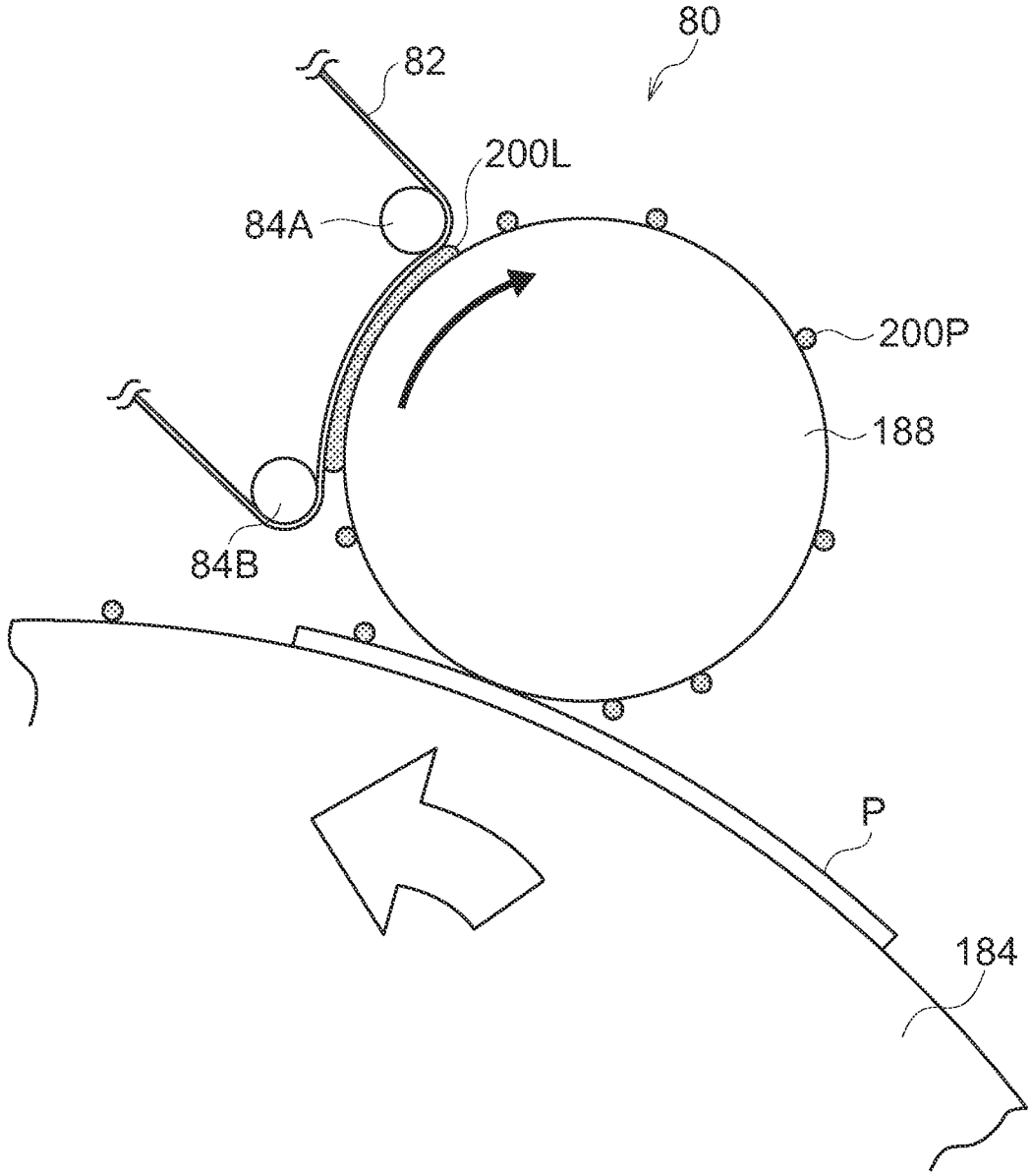
FIG. 3 is an enlarged schematic drawing showing a matting agent supplying section of an image recording device relating to the exemplary embodiment of the present invention.
Figure 4:
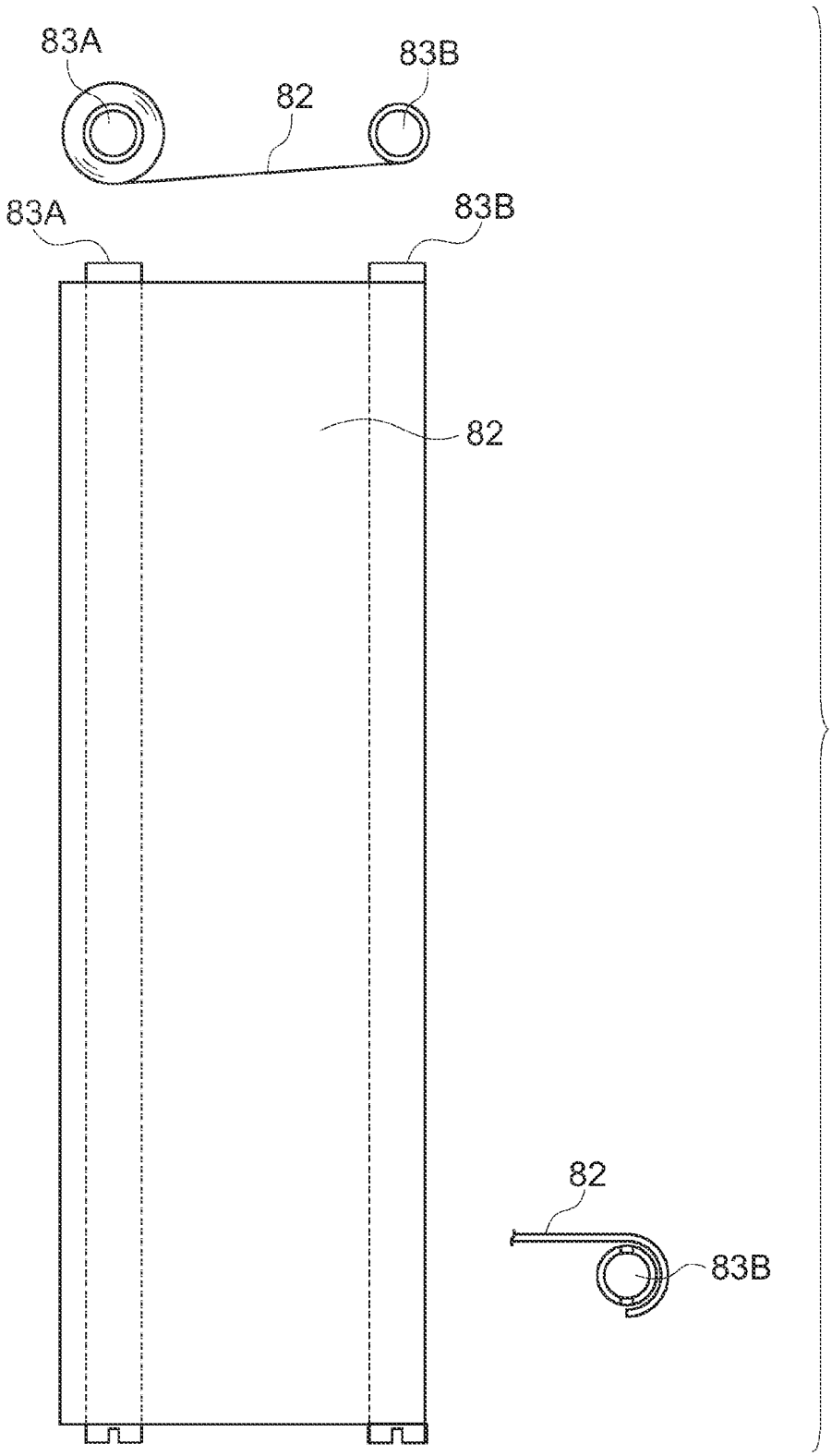
FIG. 4 is a schematic drawing showing a web take-up structure of the matting agent supplying section relating to the exemplary embodiment of the present invention.

As shown in FIG. 4, the web 82 is supplied in a state of being wound around a supply side core metal 83A and taken-up on a take-up side core metal 83B. As shown in FIG. 3, the web 82 is supported from the back side thereof by the first rod 84A and the second rod 84B, and is installed so as to abut the outer peripheral surface of the pressing roller 188.

A web unit 280, that is formed from the first rod 84A, the second rod 84B, the supply-side core metal 83A and the take-up side core metal 83B around which the web 82 is wound, and a side plate 80A, abuts and moves away from the applying roller (the pressing roller 188) at an arbitrary time. The arbitrary time for abutting may be, for example, immediately after the start of printing, and the arbitrary time for moving away may be, for example, immediately after the end of printing or when printing is stopped. The abutting and moving away of the web unit 280 is carried out, by for example, unillustrated gears or cams.

The web 82 is trained along the pressing roller 188 on the conveying path along which the web 82 is taken-up from the supply-side core metal 83A to the take-up side core metal 83B, and supplies the matting liquid 200L. Here, when the same portion of the surface of the web 82 continues to contact the pressing roller 188, the impregnated matting liquid 200L is consumed, and the matting agent particles 200P are no longer sufficiently supplied to the surface of the pressing roller 188. Therefore, the web 82 must be taken-up at a predetermined time.

Figure 5:
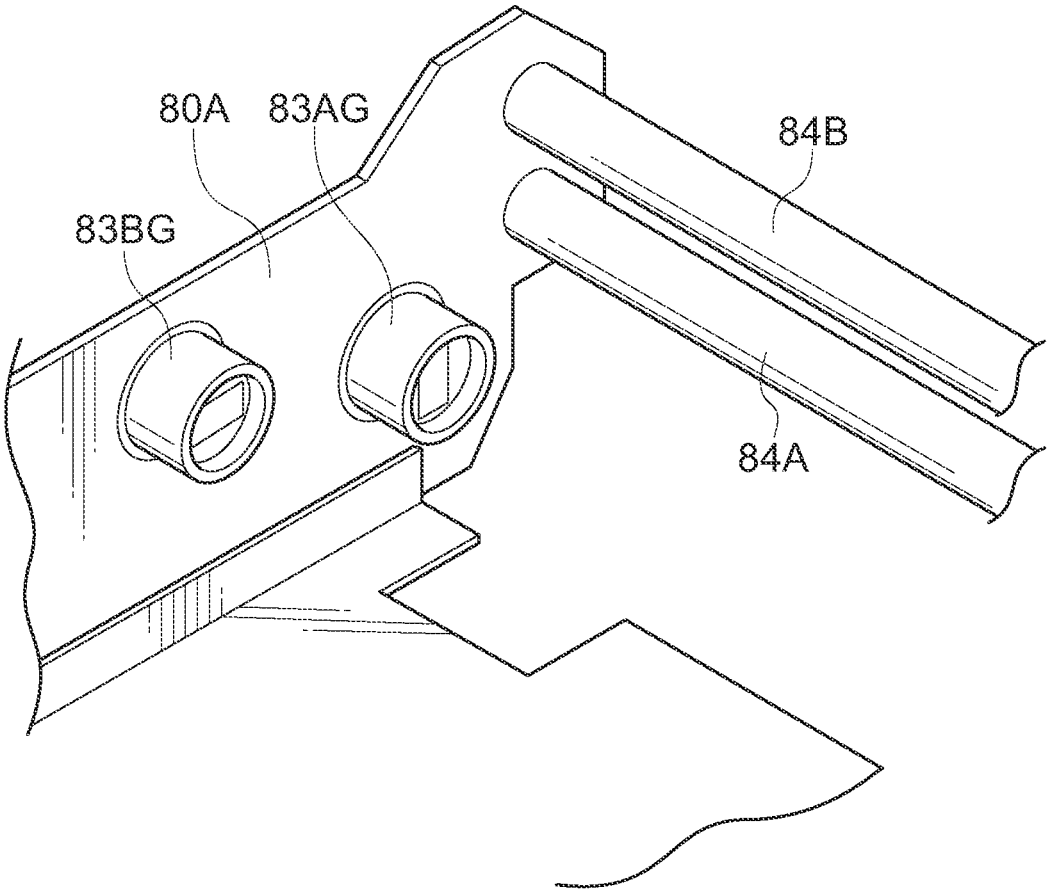
FIG. 5 is an enlarged view showing the web take-up structure of the matting agent supplying section relating to the exemplary embodiment of the present invention.

As shown in FIG. 5, respective one ends of the supply-side core metal 83A and the take-up side core metal 83B are supported so as to be able to be driven and rotated by gears 83AG, 83BG that are provided at the frame 80A. Of the gears 83AG, 83BG, at least the gear 83BG that supports the take-up side core metal 83B is driven by, for example, an unillustrated pulse motor or the like, and the take-up side core metal 83B is wound-up at a desired timing.

Due thereto, the web 82, of which feed amount is controlled arbitrarily by the number of rotational pulses of the pulse motor for example, is updated by causing the web 82 to be taken-up from the supply-side core metal 83A onto the take-up side core metal 83B interlockingly and at an arbitrary time by the respective gears 83AG, 83BG, and a fresh portion of the surface (unused surface) of the web 82 abuts the pressing roller 188. In this way, the matting liquid 200L can always be supplied to the pressing roller 188.

It is desirable to strengthen the tension for the purposes of ensuring sufficient abutting pressure of the web 82 with respect to the pressing roller 188 and suppressing slack of the web 82. For example, the back tension of the web 82 can be strengthened by increasing the rotation shaft resistance of the supply-side core metal 83A at the gear 83AG side.

Figure 6:
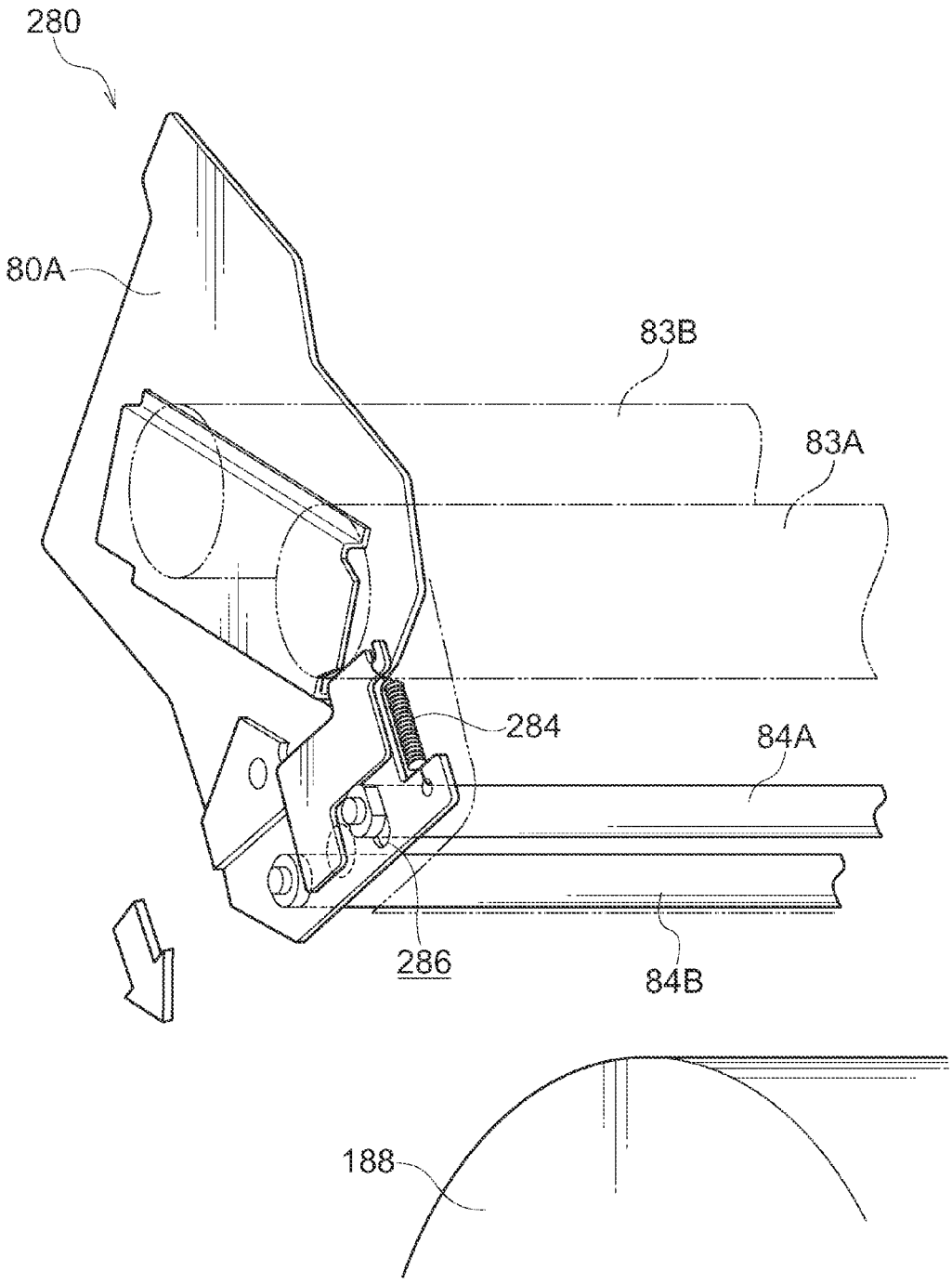
FIG. 6 is an enlarged view showing the web take-up structure of the matting agent supplying section relating to the exemplary embodiment of the present invention.

As shown in FIG. 6, the first rod 84A may be structured so as to be moveable with respect to the outer peripheral surface of the pressing roller 188, and urged by a spring. Namely, the first rod 84A, that is supported at a long hole 286 provided in the side plate 80A, may be urged in the direction of the pressing roller 188 by a spring 284 as shown in FIG. 6, and may always abut the surface of the pressing roller 188 at a predetermined pressure. In actuality, because the web 82 exists between the first rod 84A and the pressing roller 188, the web 82 is pressed against the surface of the pressing roller 188 by the force of the spring 284.

Figure 7:
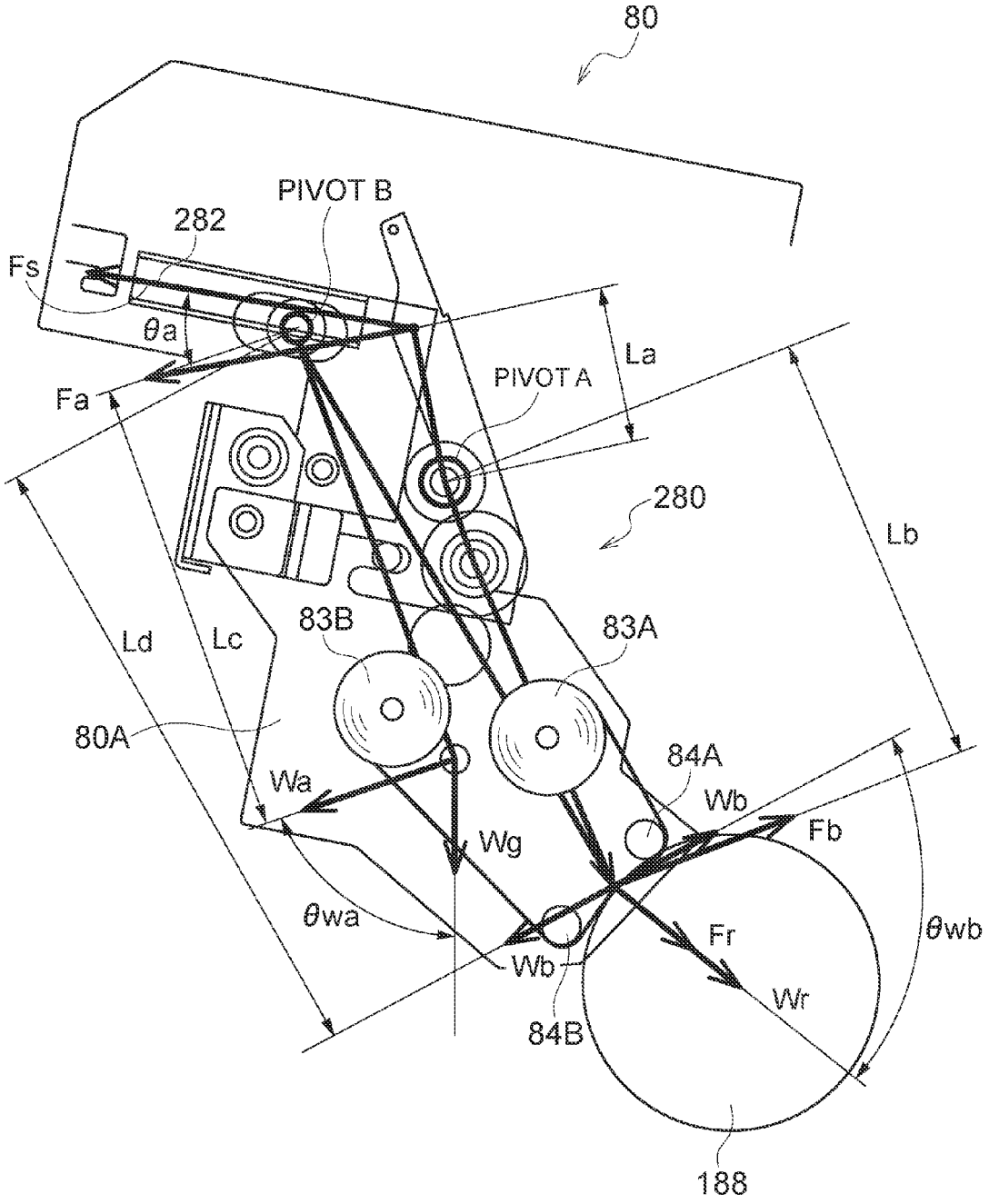
FIG. 7 is a schematic drawing showing an approaching/separating structure of the matting agent supplying section relating to the exemplary embodiment of the present invention.

As shown in FIG. 7, the pressure at which the web 82 abuts the pressing roller 188 can be controlled by, for example, the strength of a tension spring 282 in FIG. 7, and is affected also by the self-weight of the web unit 280 itself. Details thereof are described by the following formulae. Namely, when the web unit 280 is supported so as to be able to rotate with Pivot A being the center of rotation, force Fs is applied to and pulls Pivot B by the tension spring 282, and the web unit 280 abuts the outer peripheral surface of the pressing roller 188 at the first rod 84A and the web 82.

Pressurizing Force (spring):

$$Fa=Fs\times\cos\theta a$$

$$Fb=Fa\times(La/Lb)$$

$$Fr=Fb\times\cos\theta r$$

Pressurizing Force (self-weight):

$$Wa=Wg\times\cos\theta wa$$

$$Wb=Wg\times(Lc/Ld)$$

$$Wr=Wb\times\cos\theta wb$$

The pressurizing force of the web 82 on the pressing roller 188 is (Fr×2)+Wr.

Here, the effect of the pressing roller 188 scraping-off the matting agent particles 200P within the matting liquid 200L that is impregnated in the web 82 can be anticipated more when the direction of feeding of the web 82 is made to be opposite the rotating direction of the pressing roller 188. However, the feeding direction of the web 82 is not limited to the opposite direction, and may be the same direction.

Figure 8A:
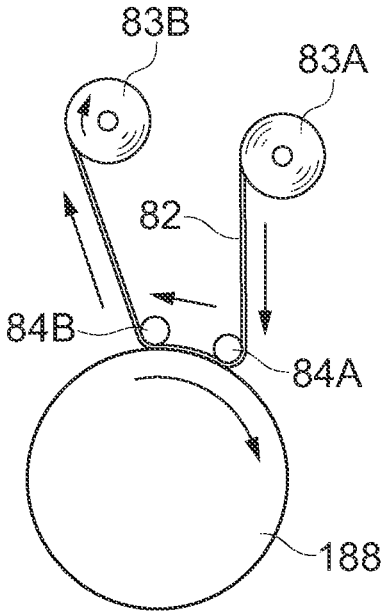
FIG. 8A through FIG. 8D are schematic drawings showing the web take-up structure of the matting agent supplying section relating to the exemplary embodiment of the present invention.
Figure 8B:
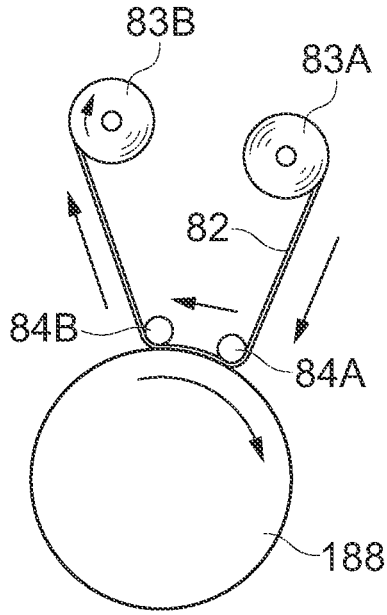
Figure 8C:
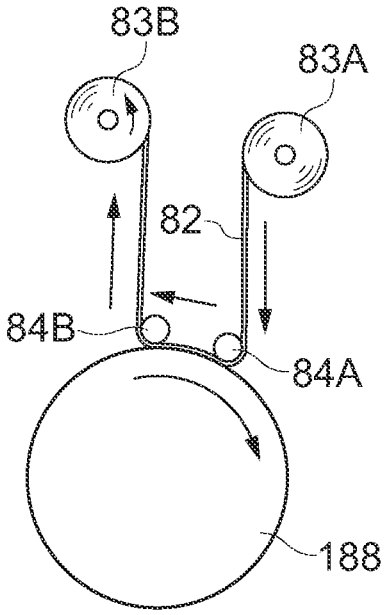
Figure 8D:
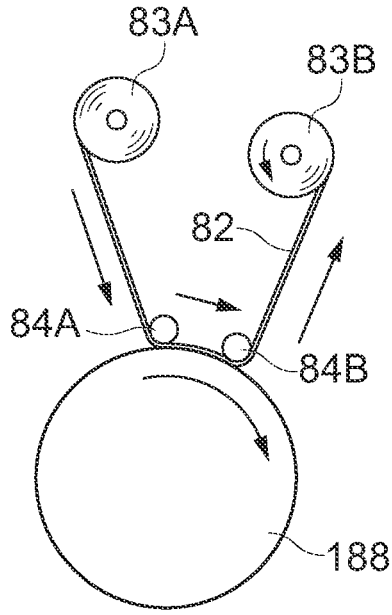

Namely, as shown in FIG. 8A through FIG. 8C, the aforementioned effect can be obtained by making the feeding direction of the web 82 be opposite the rotating direction of the pressing roller 188. However, as shown in FIG. 8D, the feeding direction of the web 82 and the rotating direction of the pressing roller 188 may be made to be the same.

At this time, the web unit 280 may be structured such that, when the web 82 is fed-out from the supply-side core metal 83A and is taken-up onto the take-up side core metal 83B, in consideration of the cleanability and the effects of the curling tendency of the web 82, the obverse and the reverse surfaces of the web 82 are reversed at the time when the web 82, that has been fed-out from the supply-side core metal 83A, is taken-up onto the take-up side core metal 83B as shown in FIG. 8A. Or, the obverse and reverse surfaces of the web 82 may be reversed at times of feeding-out/taking-up, as shown in FIG. 8A and FIG. 8C, in accordance with various conditions such as the properties of the web 82, the state of impregnation of the matting liquid 200L, and the like. The effects that all of these conditions have on the performances are shown in the table of FIG. 12 as will be described hereinafter.

<Supporting Method and Feeding Direction of Web>

By supplying the matting agent particles 200P in a state of being dispersed in a dispersion liquid as in the present exemplary embodiment, there is no floating-about of powder within the device, and therefore, the risk of dirtying the device interior is reduced. If a dispersion medium such as oil is excessively applied to the print surface at this time, uneven gloss and non-uniform density (caused by processing agent and ink repulsion) become problematic. However, by using the web 82, the matting agent particles 200P can be supplied to the pressing roller 188 in a concentrated state.

The advantage of reducing the amount of the dispersion medium can be anticipated in the present exemplary embodiment, as opposed to other methods, i.e., methods of supplying a matting agent by a coating roller or a blade. Further, in methods of coating the matting liquid 200L directly onto the pressing roller 188, there is the concern that the matting liquid 200L will be repelled and will not be able to be uniformly coated on the pressing roller 188. However, the amount of the dispersion medium is reduced owing to the interposing of the web 82, and, coupled with the effect of the matting agent particles 200P being concentrated, uniform coating of the matting agent is possible.

Further, in the present exemplary embodiment, the dispersion liquid is not coated directly on the print surface of the recording medium P, and is coated via the pressing roller 188. Therefore, dispersion liquid is not supplied excessively to the print surface. Moreover, because the matting agent particles 200P that have not been transferred to the pressing roller 188 remain on the web 82 and are recovered, the risk of the matting agent particles 200P scattering within and dirtying the device interior is reliably reduced.

The web 82 is supported from the back surface by the two rods that are the first rod 84A and the second rod 84B that are provided in a vicinity of the pressing roller 188, and planarly contacts (surface-contacts) the pressing roller 188 over a width in the peripheral direction. The transfer (first transfer) of the matting agent particles 200P to the pressing roller 188 is thereby carried out. The effects that the abutment conditions of the first rod 84A and the second rod 84B have on the performances are shown in the table of FIG. 13 as will be described hereinafter.

Due to the web 82 planarly contacting the pressing roller 188 in this way, more matting agent particles 200P can be supplied to the pressing roller 188 as compared with a case in which the web 82 is supported by a single rod (linear contact).

The web 82 is taken-up, by a predetermined feed amount, from the first rod 84A, that is provided at the supply side, in the direction of the second rod 84A, that is provided at the take-up side, and a new supply surface is updated. Due to the web 82 being updated to a new supply surface, a given number or more of the matting agent particles 200P can always be supplied to the pressing roller 188.

Further, because the web 82 is made to planarly contact the pressing roller 188, even if a portion of the web 82 that has contacted the pressing roller 188 one time or more is again made to contact the pressing roller 188, the matting agent particles 200P that remain within the web 82 can be further supplied to the pressing roller 188.

If a releasing agent such as silicone oil or the like is used as the dispersion medium that is impregnated into the web 82, not only is the stacker blocking preventing function aided, but also, image offset onto the pressing roller 188 can be prevented well.

At a portion of the web 82 where substantially all of the matting agent particles 200P have disappeared, in a vicinity of the final end of the portion that contacts the pressing roller 188, the cleaning effect of wiping-off dirtying substances such as adhered ink or the like together with the dispersion medium (oil), that remains on the surface of the pressing roller 188 that has been roughened, can be anticipated. Therefore, a situation in which indentations at the surface of the pressing roller 188 are filled-in by adhered matter and smoothed and the transfer performance deteriorates can be prevented.

As shown in FIG. 3, a bead (pool of liquid) of the matting liquid 200L is formed at the nip portion between the pressing roller 188 and the web 82 whose back surface is abutted by the first rod 84A. Due thereto, from the standpoint of being able to more stably carry out the first transfer from the web 82 to the pressing roller 188, it is more preferable for the first rod 84A to abut the pressing roller 188 (with the web 82 nipped therebetween).

The position of the first rod 84A fluctuates due to vibrations (e.g., the rising and falling of the jump stand portion of the pressing roller 188 due to impression cylinder conveying) of the recording medium supporting body (the fixing drum 184). From the standpoint of preventing the bead of the matting liquid 200L between the first rod 84A and the pressing roller 188 from becoming unstable and maintaining the stability of the first transfer performance, a form in which the abutment of the first rod 84A is by a pressing spring is more preferable, so that fluctuations in the position of the first rod 84A with respect to the pressing roller 188 can be kept to a minimum regardless of the position of the pressing roller 188.

Further, the first rod 84A being made to abut the pressing roller 188 by an excessive pressure is prevented, wear of the surface of the pressing roller 188 that has been surface roughened is reduced, and the effect of increasing the lifespan of the pressing roller 188 also can be anticipated. The amount of separation between the first rod 84A and the pressing roller 188 at this time is desirably made to be less than or equal to the thickness of the web 82, in order to provide the effect of squeezing the matting agent particles 200P off from the web 82.

The web 82, whose back surface is abutted by the second rod 84B, and the pressing roller 188 are in a state of being apart from one another. Due thereto, a situation in which the matting agent particles 200P, that remain on the surface of the pressing roller 188 from the second transfer portion, are removed at the first rod 84A is prevented, and the matting liquid 200L is again taken-into the bead, and, from the standpoint of reusability, it is more preferable that the second rod 84B be in a state of being apart from the pressing roller 188.

However, from the standpoint of maintaining the planar contact, it is desirable that the amount of separation of the second rod 84B from the pressing roller 188 be kept to the minimum and within a range of 1 to 2 mm. Further, by setting the second rod 84B apart from the pressing roller 188, wear of the pressing roller 188 whose surface has been roughened can also be reduced. Further, from the standpoint of avoiding recovery of the matting agent particles 200P that remain on the pressing roller 188, the amount of separation of the second rod 84B from the pressing roller 188 is desirably made to be wider than the width of the web 82.

Making the feeding direction of the web 82 and the rotating direction of the pressing roller 188 be opposite one another is more preferable because the effect of the pressing roller 188 scraping-off the matting agent particles 200P that are within the web 82 can be expected.

As shown in FIG. 3, the matting agent particles 200P that have been supplied to the surface of the pressing roller 188 are transferred and applied to (secondarily transferred onto) the recording medium P (printing sheet) that is on the fixing drum 184. At the image portions of the recording medium P (printed matter), the matting agent particles 200P are transferred from the pressing roller 188 due to the tackiness of the ink film. At the non-image portions, the matting agent particles 200P are not transferred from the pressing roller 188. In this way, the matting agent particles 200P are selectively applied to the image portions.

The matting agent particles 200P, that have been applied to the image portions, are applied by pressing by the pressing roller 188, and therefore, stick to the image portions and do not fall-off in later processes, and dirtying by the matting agent particles 200P can be prevented.

<Pressing Roller Surface Roughening Treatment>

In order to efficiently execute the above-described first transfer and second transfer, it is desirable that the surface of the pressing roller 188 be subjected to a surface roughening treatment. By roughening the surface of the pressing roller 188, when the web 82 is made to contact the surface-roughened pressing roller 188 over a width thereof in the peripheral direction, the surface of the pressing roller 188 is not excessively dampened by the components of the matting liquid 200L that have seeped-out from the web 82, and the matting agent particles 200P can be selectively scraped-off. Therefore, the performance of the first transfer from the web 82 to the pressing roller 188 can be improved. The effects that surface roughening of the pressing roller 188 have on the performances are shown in the table of FIG. 14 as will be described hereinafter.

When the pressing roller 188 is made to be a smooth roller, even if the matting agent particles 200P that have been applied to the roller surface are transferred once onto the recording medium P (printed matter), there is the concern that they will be wiped-off from the printed matter surface by the pressing roller 188 itself, and the transfer efficiency will deteriorate. By causing the wiping-off ability of the pressing roller 188 itself to deteriorate by roughening the surface of the pressing roller 188, the matting agent particles 200P slip out of the concave portions of the indentations and protrusions of the surface of the pressing roller 188 and can suitably remain on the printed matter, and an improvement in the second transfer performance also can be expected.

At this time, it is desirable that the surface of the pressing roller 188 be roughened by a surface roughening treatment such that a root mean square roughness Rq is greater than or equal to 2 μm. Further, limiting Rq to less than or equal to 10 μm is preferable from the standpoint of preventing image offset onto the pressing roller 188. A sandblasting treatment or a sandpaper treatment is preferably used as this surface roughening treatment.

By carrying out a sandblasting treatment on the surface of the pressing roller 188, random indentations and protrusions can be formed isotropically while the particle size and pressure are controlled, and the matting agent particles 200P can be applied uniformly onto the recording medium P.

Or, by carrying out abrading by sandpaper (a sandpaper treatment) so as to form grooves that run along a direction of a predetermined angle $\alpha$ (where $0° \leq \alpha \leq 90°$ with respect to the transverse direction of the pressing roller 188, a pattern of indentations and protrusions can be formed anisotropically on the surface of the pressing roller 188 while the roughness is controlled, and the matting agent particles 200P can be applied uniformly onto the recording medium P.

It is more preferable that the aforementioned predetermined angle $\alpha$ be $0° < \alpha < 60°$. In the application of particles from the web 82 onto the surface of the pressing roller 188, the scraping-off effect becomes a maximum when $\alpha = 0°$. On the other hand, in the application of the matting agent particles 200P from the surface of the pressing roller 188 onto the surface of the recording medium P, the releasing effect becomes a maximum when $\alpha = 90°$. Because much importance must be placed on the angle that maximizes the scraping-off effect (=the first transfer) and the releasing effect (=the second transfer) is also considered as a secondary point, the range $0° < \alpha < 60°$ is the most preferable range of angles.

When the aforementioned angle is in a vicinity of 0°, the releasing effect from the pressing roller 188 deteriorates, but can be sufficiently compensated for by the pressure of the pressing roller 188 and the tackiness of the ink film of the image portions. Therefore, the transfer performance at 0° to 60° is uniformly good. When the angle exceeds 60°, the scraping-off effect deteriorates, and therefore, the transfer performance deteriorates.

<Properties of Pressing Roller Surface>

From the standpoint of improving the second transfer performance, it is preferable that the surface of the pressing roller 188 be a material having little surface energy. A roller on which a fluorine film is wound is preferable, and, for example, PFA is suitably used. At the time of the first transfer, an excessive supply of the dispersion liquid (oil) from the web 82 is prevented, and, due to the releasability at the time of the second transfer, it is easy for the matting agent particles 200P themselves to be transferred onto the recording medium P (the printed matter). Effects of the surface roughness properties of the pressing roller 188 on performances are shown in the table of FIG. 15 as will be described later.

For example, the pressing roller 188 may be structured to have a rubber layer of a rubber hardness of less than or equal to 70° and a thickness of greater than or equal to 1 mm, and a surface film layer that is wound on the rubber layer and has a thickness of from greater than or equal to 50 μm to less than or equal to 200 μm. From the standpoint of durability of the surface film layer with respect to the surface roughening treatment, a thick surface film is good, but if the surface film is too thick, the stress difference due to the difference between the inner diameter and the outer diameter at the time of winding the surface film on the rubber layer becomes large which is unsuitable.

Further, in order to make the number of transferred particles large, it is good for the rubber layer to deform moderately with respect to the size of the particles. Rubbers of a flexible rubber hardness are good, and a rubber hardness of less than or equal to 70° is good. It is good for the thickness of the rubber layer to be greater than or equal to 1 mm which deforms easily.

<Structure for Causing Pressing Roller to Move Away and Contact>

In order for the pressing roller 188 to not dirty the printed matter supporting body (the fixing drum 184) by the matting agent particles 200P (and the matting liquid 200L), it is preferable that the pressing roller 188 be moved apart from the surface of the fixing drum 184 at the regions thereof other than the region where the recording medium P is not located.

In order to prevent a situation in which the matting agent particles 200P (and the matting liquid 200L) excessively adhere to and dirty the pressing roller 188 and the printed matter, a cleaning mechanism may be provided at the pressing roller 188 or at a place of the printed matter supporting body (the fixing drum 184) other than the portion thereof that abuts the pressing roller 188. For example, cleaning by scraping-off or wiping-off or the like by a blade or a wiper is preferable. Further, the dirtying substances of the matting agent particles 200P (and the matting liquid 200L) may be adhered to and removed by passing a damaged sheet through the device interior as a cleaning sheet.

The degree of sticking of the matting agent particles 200P to the image portions of the recording medium P may be adjusted by means such as follows. Namely, the degree of sticking of the matting agent particles 200P to the image portions can be controlled by controlling the tackiness of the ink film, for example, controlling the tackiness by changing the dried state of the ink film by controlling the drying conditions.

Further, the matting agent particles 200P may be embedded into the ink film and the degree of sticking thereof may be strengthened by strengthening the fixing nip pressure, or by providing a second pressing roller separately from the pressing roller 188 and pressing the matte agent particles 200P twice from above.

The needed number of particles differs also in accordance with the type of paper that is used for the printed matter and the applied amount of ink. Therefore, the amount by which the web 82 is fed may be made to be variable in accordance with the paper type or the ink amount.

The nearer that the recording medium P is processed to the starting stage of a job, the lower that the recording medium P is positioned in the stack of printed matter after discharging, and the easier it is for stacker blocking to worsen due to the weight of the printed matter thereabove. Accordingly, the number of the matting agent particles 200P that are needed is greater the nearer to the start of a job. From the standpoint of ensuring a uniform number of the matting agent particles 200P throughout a job, the feed amount of the web 82 may be made to be variable throughout the job, and the feed amount may be controlled such that the feed amount is greater at first and decreases at the end.

<Abutting and Moving Away of Pressing Roller>

Figure 9:
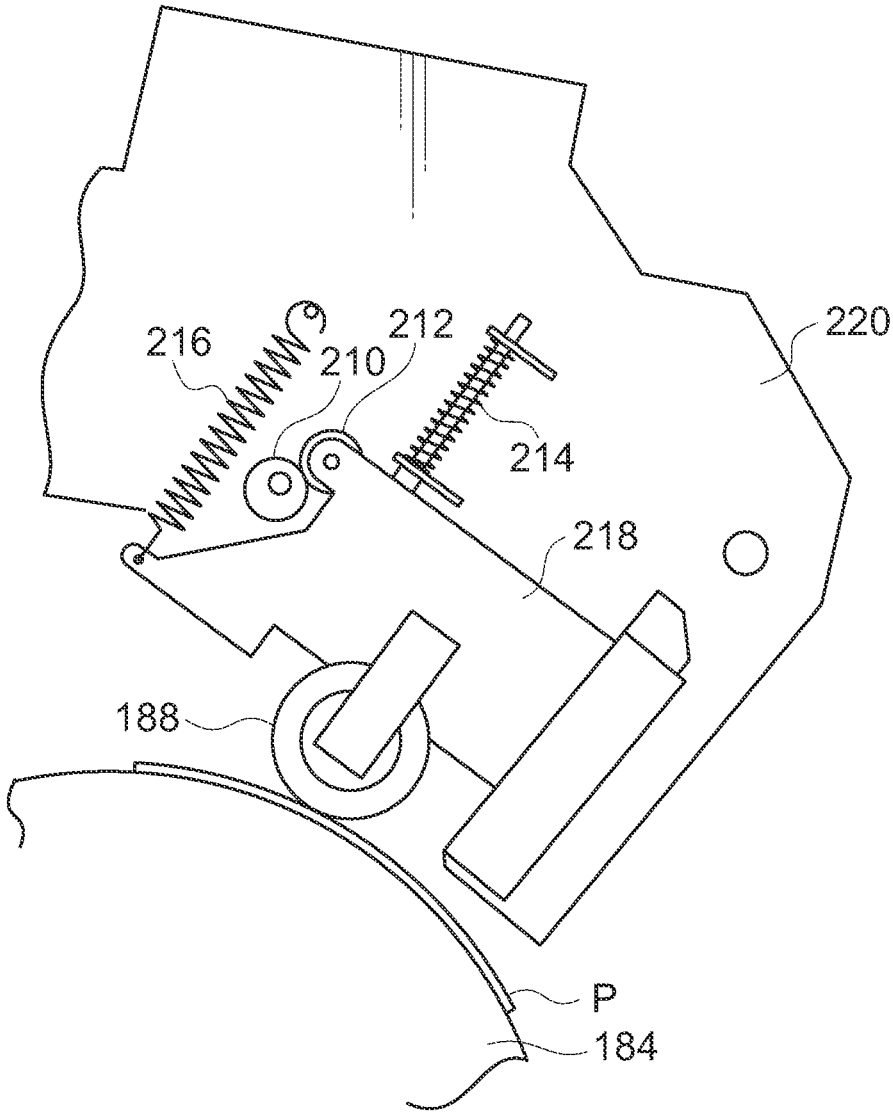
FIG. 9 is a schematic drawing showing an approaching/separating structure of a fixing section of the image recording device relating to the exemplary embodiment of the present invention.

As shown in FIG. 9, the pressing roller 188 is supported so as to be movable in directions of approaching and moving away from the fixing drum 184 and the recording medium P that is held on the surface thereof, and the pressing roller 188 is structured so as to be able to abut and separate from the fixing drum 184 and the recording medium P. If the pressing roller 188 is always pressing, the pressing roller 188 directly contacts the surface of the fixing drum 184 at times when the recording medium P is not being held at the outer peripheral surface of the fixing drum 184. Therefore, the reason for providing the above-described structure is in order to prevent scratching, the copying of dirtying substances, and the like due to the respective outer peripheral surfaces of the pressing roller 188 and the fixing drum 184 contacting one another.

Due thereto, because the pressing roller 188, on whose surface the matting agent particles 200P are adhering, does not directly contact the fixing drum 184, there is little concern that the surface of the fixing drum 184 will be dirtied by the matting agent particles 200P that remain at the pressing roller 188 without having been transferred onto the surface of the recording medium P.

Concretely, as shown in FIG. 9, when a fixing frame 218, that is swingably supported at a main body frame 220, urges the pressing roller 188 toward the fixing drum 184 by a push spring 214 and a pull spring 216, a separating cam 210 rotates at a predetermined timing and pushes a cam roller 212 in the moving away direction, i.e., pushes the fixing frame 218 in the direction in which the pressing roller 188 moves away from the fixing drum 184.

The cam roller 212 is urged toward the separating cam 210 by the push spring 214. For example, at a place between the respective recording media P or the like on the fixing drum 184, when the separating cam 210 rotates and pushes the cam roller 212 upward, the pressing roller 188 separates from the surface of the fixing drum 184, and the pressing roller 188 is prevented from contacting the fixing drum 184 at a place where no recording medium P exists.

<Other Forms>

Figure 10:
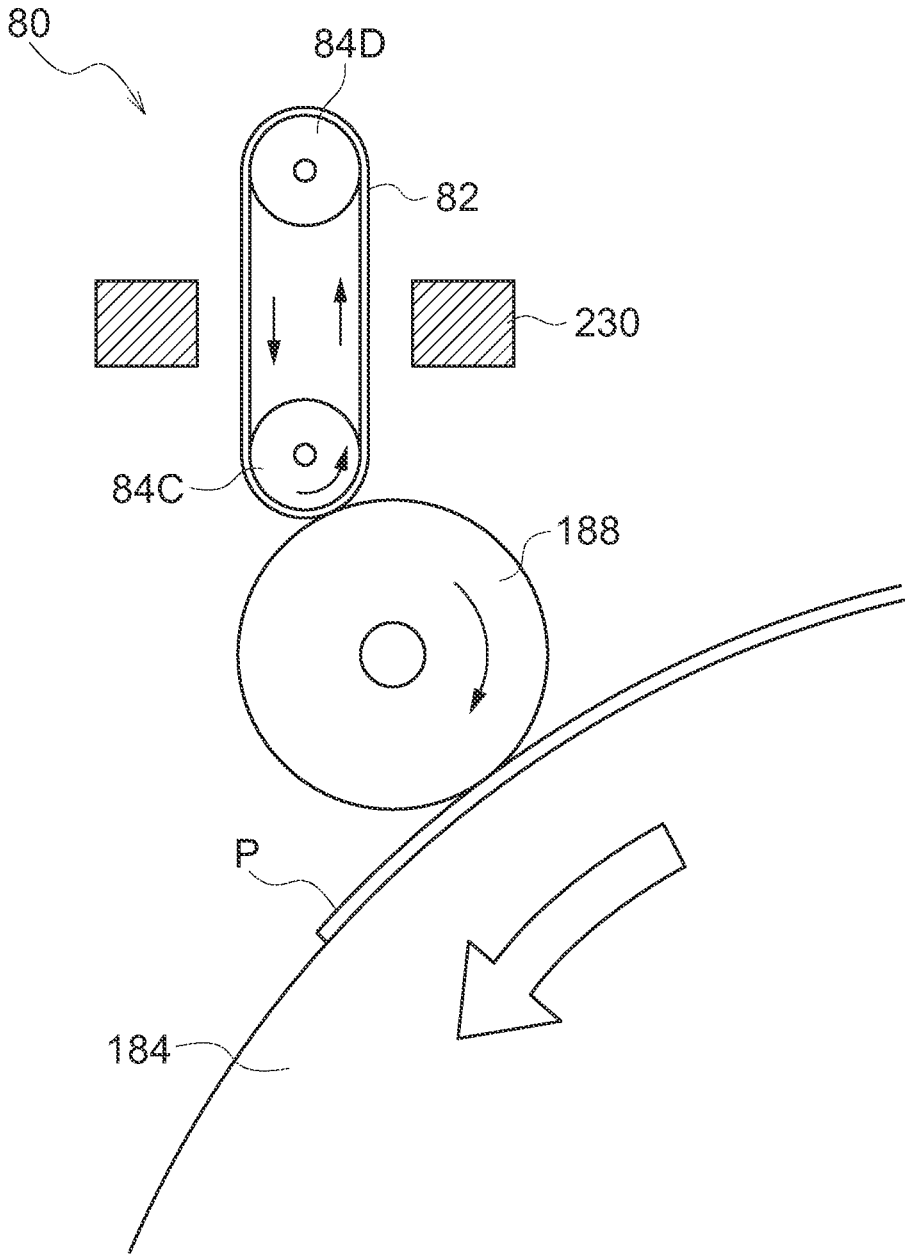
FIG. 10 is an enlarged schematic drawing showing the matting agent supplying section of the image recording device relating to another exemplary embodiment of the present invention.

A matting agent applying device relating to another form of the present invention is shown in FIG. 10. As shown in FIG. 10, other than the wound form in which the web 82 is taken-up around rollers, the web 82 may be structured so as to be shaped as an endless belt and supply the matting agent particles 200P to the pressing roller 188.

For example, as shown in FIG. 10, the web 82 that is shaped as an endless belt may be trained between rods 84C, 84D, and the web 82 may be pushed against the surface of the pressing roller 188 at the rod 84C. In order to repeatedly use a same portion of the web 82, the matting liquid 200L must be replenished thereto at all times, and therefore, a matting liquid ejecting head 230 or the like is provided. By replenishing the web 82 with an amount of the matte liquid 200L corresponding to the amount thereof that has been consumed, the matting agent particles 200P can be supplied to the pressing roller 188 stably over a long time.

When taking into consideration the points that there is no need to replace the supply-side core metal 83A and the take-up side core metal 83B of the web 82 because the web 82 is not taken-up in this structure, and that the matting liquid 200L is ejected stably from the matting liquid ejecting head 230, the number of maintenance processes can be reduced.

Figure 11:
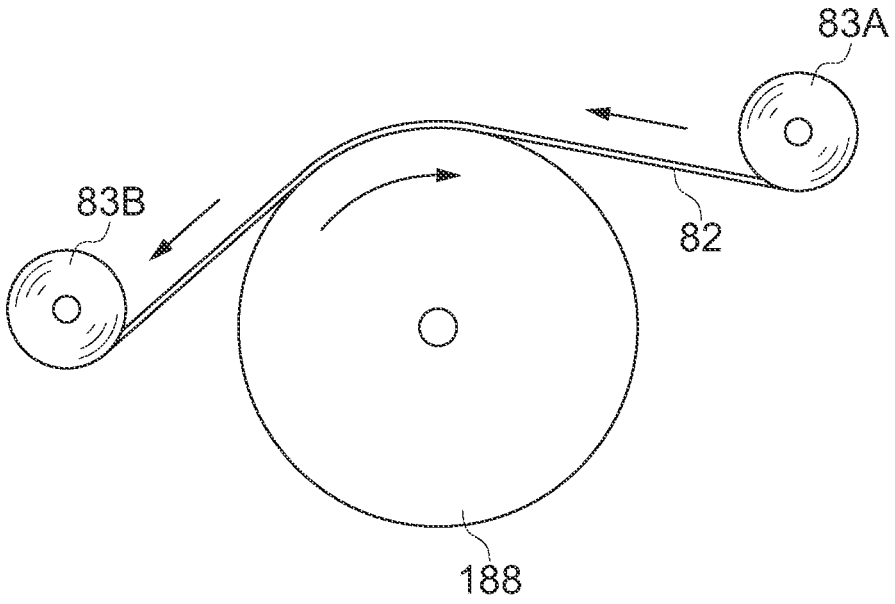
FIG. 11 is an enlarged schematic drawing showing the matting agent supplying section of the image recording device relating to yet another exemplary embodiment of the present invention.

A matting agent applying device relating to another form of the present invention is shown in FIG. 11. As shown in FIG. 11, without using the first rod 84A and the second rod 84B, the web 82 may be trained along the pressing roller 188 while on the conveying path of being taken-up from the supply-side core metal 83A toward the take-up side core metal 83B, and supply the matting agent particles 200P to the pressing roller 188.

In this structure, because the first rod 84A and the second rod 84B are not used, the length over which and the pressing force by which the web 82 contacts the pressing roller 188 are determined by the positional relationship between the supply-side core metal 83A and the take-up side core metal 83B and the pressing roller 188. Because the first rod 84A and the second rod 84B do not exist, the only member that the matting liquid 200L contacts is, other than the supply-side core metal 83A and the take-up side core metal 83B, the pressing roller 188, and a situation in which the matting agent particles 200P adhere to the device interior can be prevented even more efficiently.

<Composition and Performance Evaluation of Web and Matting Liquid>

The matting liquid 200L and the web 82 were adjusted as described hereinafter, and evaluation of performances was carried out on an actual device (the inkjet recording device 100 relating to the present exemplary embodiment).

1. Preparation of Web Member 1 silicone oil ("KF-96-100cs" manufactured by Shin-Etsu Chemical Co., Ltd.) 70.0% by mass polymethylmethacrylate (PMMA) particles (manufactured by Nippon Shokubai Co., Ltd., "CHEMISNOW MX-2000", volume average particle diameter 20 μm) 30.0% by mass One liter of the liquid of the above-described composition was mixed-together for 10 minutes at 8000 rpm in an emulsification device manufactured by Silverson Machines, Inc., and powder particle dispersion liquid 1 was prepared. The powder particle dispersion liquid 1 was impregnated into a non-woven fabric so as to become 150 g/m$^2$, and web member 1 was prepared. KYS80 (void diameter of 85 μm per one fiber) manufactured by Kureha Ltd. was used as the non-woven fabric.

2. Preparation of Web Member 2 silicone oil ("KR-500" manufactured by Shin-Etsu Chemical Co., Ltd.) 26.3% by mass silicone oil ("KF-945" manufactured by Shin-Etsu Chemical Co., Ltd.) 43.7% by mass polystyrene particles (manufactured by Techno Polymer Co., Ltd., "SBX-17", volume average particle diameter 16 μm) 30.0% by mass Other than this, the formulation was the same as that of web member 1.

3. Preparation of Web Member 3 silicone oil ("KF-96-100cs" manufactured by Shin-Etsu Chemical Co., Ltd.) 67.9% by mass silicone oil ("KF-4917" manufactured by Shin-Etsu Chemical Co., Ltd.) 2.1% by mass polyethylene particles (manufactured by Mitsui Chemicals, Inc. "MIPELON XBM-220", volume average particle diameter 33 μm) 30.0% by mass Other than this, the formulation was the same as that of web member 1.

4. Preparation of Web Member 4

One liter of the liquid of the same composition as web member 1 was mixed-together for 10 minutes at 8000 rpm in an emulsification device manufactured by Silverson Machines, Inc., and the powder particle dispersion liquid 1 was prepared. The powder particle dispersion liquid 1 was impregnated into a non-woven fabric so as to become 75 g/m$^2$, and web member 4 was prepared. T220 (void diameter of 26 μm per one fiber) manufactured by Advantech Co., Ltd. was used as the non-woven fabric.

5. Preparation of Web Member 5

One liter of the liquid of the same composition as web member 2 was used. Other than this, the formulation was the same as that of web 4.

6. Preparation of Web Member 6

One liter of the liquid of the same composition as web member 3 was used. Other than this, the formulation was the same as that of web 4.

7. Preparation of Web Member 7

One liter of the liquid of the same composition as web member 1 was mixed-together for 10 minutes at 8000 rpm in an emulsification device manufactured by Silverson Machines, Inc., and the powder particle dispersion liquid 1 was prepared. The powder particle dispersion liquid 1 was impregnated into a non-woven fabric so as to become 50 g/m$^2$, and web member 7 was prepared. A mixed material of polyamide and polyester having a weight of 30 g/m$^2$, a thickness of 0.1 mm, and a void diameter of 21 μm per one fiber was used as the non-woven fabric.

8. Preparation of Web Member 8

One liter of the liquid of the same composition as web member 2 was used. Other than this, the formulation was the same as that of web 7.

9. Preparation of Web Member 9

One liter of the liquid of the same composition as web member 3 was used. Other than this, the formulation was the same as that of web 7.

10. Preparation of Web Member 10

100.0% by mass of silicone oil ("KF-96-100cs" manufactured by Shin-Etsu Chemical Co., Ltd.) was used. Other than this, the formulation was the same as that of web member 1. Polymethylmethacrylate (PMMA) particles were not included.

By using the above-described respective web members, a striped image of a width of 50 mm was printed onto both sides of 3000 sheets of OK TOPCOAT 157gsm (manufactured by Oji Paper Co., Ltd.) by using an ink amount of 5 pL in the printer relating to the present exemplary embodiment and the sheets were stacked. The state of occurrence of stacker blocking after six hours elapsed, uneven gloss (immediately after, and after one day passed), the level of dirtying of the device interior, roller durability, and roller offset were evaluated.

The standards for evaluation are as follows.

(Stacker Blocking: D and Better are the Examples)

A: no occurrence at 3000 sheets or more
B: no occurrence at 2500 sheets or more from the top
C: no occurrence at 2000 sheets or more from the top
D: no occurrence at 1500 sheets or more from the top
E: no occurrence at 1000 sheets or more from the top
F: occurred even at less than 1000 sheets from the top (Others: B and better are the Examples)

A: no problems
B: permissible
C: not permissible

Evaluation in accordance with an actual device was carried out under the above-described contents. The results are shown in FIG. 12 through FIG. 15. Namely, results relating to the basic shape, the surface shape of the pressing roller 188 and the pore (void) diameter of the web 82 are shown in FIG. 12. Results relating to the abutment conditions of the rods 84 are shown in FIG. 13. Results relating to the surface roughening conditions of the pressing roller 188 are shown in FIG. 14. Results relating to the properties of the pressing roller 188 and the feeding direction of the web 82 are shown in FIG. 15. Combinations, for which no problems are mentioned in the following explanation of the evaluation results shown in the tables, are examples that can be implemented.

Evaluation results with regard to combinations of the basic shape, the surface shape of the pressing roller 188 and the pore (void) diameter size of the web 82, and with regard to matting agent application by other methods, are shown in FIG. 12.

As shown in FIG. 12, the combinations, in which the pressing roller 188 is made to be a surface-roughened roller and the web 82 is made to be the web members 1 through 3, can be used without any problems at all. With combinations other than these, the transfer performance of the matting agent particles 200P deteriorates, and therefore, the stacker blocking performance deteriorates.

Further, as shown in FIG. 12, without the matting liquid 200L, the stacker blocking performance is poor, and the uneven gloss worsens due to excess oil when the web 82 is made to directly contact the recording medium P, and the uneven gloss worsens due to non-uniform transfer in the coating of the matting liquid 200L by a blade, and the uneven gloss worsens when the matting liquid 200L is supplied to the pressing roller 188 by a coating roller instead of the web 82.

When the matting agent particles 200P are sprayed directly in the state of a powder within the sheet discharging unit 192 instead of the matting liquid 200L, with spraying of an amount that satisfies the stacker blocking performance, dirtying of the device interior is poor. With a sprayed amount of an extent that dirtying of the device interior is permissible, the stacker blocking performance becomes poor.

Results of evaluation with respect to combinations of abutment or separation of the first rod 84A and the second rod 84B, and the movable or fixed state of the first rod 84A, are shown in FIG. 13.

As shown in FIG. 13, under the rod abutment conditions that the first rod 84A abuts the pressing roller 188, the second rod 84B is apart from the pressing roller 188, and the first rod can be pushed and moved by a spring, there are no problems at all with the stacker blocking performance, uneven gloss (immediately after and one day after), and the roller cleaning performance of the pressing roller 188, and these conditions can be utilized.

Namely, if the first rod 84A is set apart from the pressing roller 188, a deterioration in the transfer performance due to instability of the pool of liquid arises. If the second rod 84B is made to abut the pressing roller 188, a deterioration in the transfer performance due to a decrease in the re-utilization rate of the matte agent particles 200P arises. With one rod, the transfer performance and cleaning performance deteriorate due to the linear contact. When the first rod 84A is fixed, dispersion in the transfer performance arises due to the decreased ability of the first rod 184 to follow the pressing roller 188.

The results of evaluation with respect to combinations of surface roughening conditions of the surface of the pressing roller 188 are shown in FIG. 14.

As shown in FIG. 14, if the surface roughness of the pressing roller 188 is low, the transfer performance deteriorates due to an insufficient ability to scrape-off the matting liquid 200, and the stacker blocking performance deteriorates. Further, if the surface roughness is excessive, the roller offset performance (image copying) of the pressing roller 188 deteriorates. Moreover, if the angle at which grooves are formed in the surface of the pressing roller 188 is within the range of 0 to 60°, there are no problems with the stacker blocking performance and the roller offset performance.

Results of evaluation of the combinations of the surface energy, the surface layer thickness, the material of the roller, the rubber hardness, and the thickness of the pressing roller 188, and the differences in performances in accordance with the feeding direction of the web 82, are shown in FIG. 15.

As shown in FIG. 15, when the surface energy of the pressing roller 188 is lower, the secondary transfer performance is excellent, and therefore, the stacker blocking performance is excellent. If the thickness of the surface layer is too thin, durability deteriorates, whereas if the thickness of the surface layer is too thick, the winding-on performance of the surface layer deteriorates, and therefore, the durability deteriorates in this case as well.

For the material of the pressing roller 188, there are no problems with silicon rubber, fluorine rubber and the like. However, with hard materials such as aluminum and the like, the pressing effect is insufficient due to insufficient elasticity, and the matting agent transfer performance deteriorates. In the case of rubber, if the rubber hardness is too high or the thickness is too thin, similarly, the pressing effect is insufficient due to insufficient elasticity, and the matting agent transfer performance deteriorates.

The stacker blocking performance and the roller cleaning performance are both better when the direction of feeding of the web 82 is opposite to the rotating direction of the pressing roller 188.

CONCLUSION

As described above, the present exemplary embodiment is structured such that the web 82, in which the matting liquid 200L is impregnated, is made to contact the surface of the pressing roller 188, and the transferred matting agent particles 200P are applied by pressing to the surface of the recording medium P. Therefore, the following effects are achieved.

Namely, because the matting agent particles 200P are supplied in a form of being dispersed within a liquid as a dispersion liquid, powder does not float-about within the device, and the risk of dirtying the device interior decreases.

When a dispersion medium such as oil is excessively applied to the print surface of the recording medium P, uneven gloss and non-uniform density (caused by processing agent and ink repulsion) become problematic. However, by using the web 82 that is a fabric material, supply onto the pressing roller 188 in a particle concentrated state is possible. As compared with other supply methods that do not carry out transfer via a fabric material, such as methods using a coating roller or blade coating or the like, the advantage that the amount of the dispersion medium is reduced can be expected.

Or, with a method of directly coating a liquid onto the pressing roller 188, there is the concern that the liquid will be repelled on the roller and will not be able to be coated uniformly. By carrying out transfer via the web 82 that is a fabric material, the amount of the dispersion medium is reduced, and coupled with the effect that the particles are concentrated, uniform coating becomes possible.

Moreover, because the dispersion liquid is not coated directly on the print surface and is coated via the pressing roller 188, the dispersion medium is not excessively supplied to the print surface. Further, the matting agent particles 200P, that were not transferred onto the pressing roller 188, remain on the web 82 are recovered, and therefore, the risk of the matting agent particles 200P dirtying the device interior is reliably reduced.

In the present invention, because the matting liquid 200L is transferred directly onto the pressing roller 188 by the web 82, as compared with a method of spraying a powder or a liquid, diffusion within the device is prevented, and there is no need for a drying process or the like after coating, and the device structure can be made to be simple and inexpensive. Similarly, as compared with a method that blows-out a powder onto the recording medium P, diffusion of the matting agent particles 200P within the device can be prevented because the method of application is application by pressing by the pressing roller 188.

Further, the matting agent particles 200P, that are applied to the image portions of the recording medium P, are applied by pressing by the pressing roller 188. Therefore, the matting agent particles 200P stick to the image portions, and there is little falling-off of the particles in later processes. Dirtying of the device interior or other recording media P due to the matting agent particles 200P that have fallen-off can be prevented.

<Others>

An exemplary embodiment of the present invention has been described above, but the present invention is not limited in any way to the exemplary embodiment, and can, of course, be embodied in various forms within a scope that does not deviate from the gist of the present invention.

For example, the above-described exemplary embodiment gives an example of a structure of the inkjet recording device that uses aqueous ink that contains thermoplastic resin and color material, but the present invention is not limited to this. For example, a structure that uses an ultraviolet curing ink, or a structure that uses an inkjet method that ejects usual ink onto regular paper, may be made to be mechanisms to which embodiments of the present invention are applied.

What is claimed is:

1. A matting agent applying device comprising:

an application strip material that is impregnated with a dispersion liquid in which matting agent particles are dispersed; and an application roller to whose surface the dispersion liquid is supplied due to the application roller contacting the application strip material, and that applies, by pressing, the matting agent particles that are within the dispersion liquid to a surface of a recording medium, wherein, on a conveying path along which the application strip material is conveyed from a state of being wound on a supply roller toward a take-up roller and is taken-up on the take-up roller, the application strip material is trained along a surface of the application roller, and due thereto, the dispersion liquid is supplied to the surface of the application roller.

2. The matting agent applying device of claim 1, wherein the application strip material is trained around a first rod that is at a conveying direction upstream side and a second rod that is at a conveying direction downstream side, and contacts the application roller over a length in a peripheral direction of the application roller.

3. The matting agent applying device of claim 2, wherein a rotating direction of the application roller and a feeding direction of the application strip material are opposite one another.

4. The matting agent applying device of claim 2, wherein the application strip material is made to abut an outer peripheral surface of the application roller at the first rod.

5. The matting agent applying device of claim 4, wherein the first rod is urged by a spring toward the outer peripheral surface of the application roller, and causes the application strip material to abut the outer peripheral surface of the application roller.

6. The matting agent applying device of claim 2, wherein the second rod is set apart from an outer peripheral surface of the application roller.

7. The matting agent applying device of claim 1, wherein an outer peripheral surface of the application roller is subjected to a surface roughening treatment.

8. The matting agent applying device of claim 7, wherein the surface roughening treatment of the application roller comprises a sandblasting treatment.

9. The matting agent applying device of claim 8, wherein the sandblasting treatment comprises abrading the outer peripheral surface of the application roller by sandpaper at an angle $\alpha$ that is $0° \leq \alpha \leq 90°$ with respect to a peripheral direction.

10. The matting agent applying device of claim 9, wherein the angle $\alpha$ is $0° < \alpha < 60°$.

11. The matting agent applying device of claim 7, wherein a root mean square roughness Rq of the outer peripheral surface of the application roller is 2 μm to 10 μm.

12. The matting agent applying device of claim 1, wherein the application roller is an elastic roller.

13. The matting agent applying device of claim 1, wherein an outer peripheral surface of the application roller has surface energy of 10 mN/m to 40 mN/m.

14. The matting agent applying device of claim 1, wherein the application roller comprises a rubber layer having a rubber hardness of 30° to 70° and a thickness of 1 mm to 8 mm, and a surface film layer that is formed by a fluorine film and that covers the rubber layer from an exterior and has a thickness of 50 μm to 200 μm.

15. The matting agent applying device of claim 1, wherein the application strip material is formed of fibers, and a void pore diameter of a mesh of the application strip material is 25 μm to 150 μm.

16. An inkjet recording device comprising the matting agent applying device of claim 1.

* * * * *